US011225836B2

(12) United States Patent
Kronman

(10) Patent No.: US 11,225,836 B2
(45) Date of Patent: Jan. 18, 2022

(54) PULSED-POWER DRILL BIT GROUND RING WITH VARIABLE OUTER DIAMETER

(71) Applicant: Halliburton Energy Services, Inc., Houston, TX (US)

(72) Inventor: Jacob H. Kronman, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 10 days.

(21) Appl. No.: 16/840,953

(22) Filed: Apr. 6, 2020

(65) Prior Publication Data

US 2021/0310309 A1 Oct. 7, 2021

(51) Int. Cl.
*E21B 7/15* (2006.01)

(52) U.S. Cl.
CPC ..... *E21B 7/15* (2013.01)

(58) Field of Classification Search
CPC ..... E21B 7/15; E21B 10/00
See application file for complete search history.

(56) References Cited

U.S. PATENT DOCUMENTS

2008/0302577 A1 12/2008 Pile
2009/0133929 A1* 5/2009 Rodland ..... E21B 10/60 175/16
2012/0055711 A1 3/2012 Brannigan et al.
2013/0032406 A1* 2/2013 Comeaux ..... E21C 37/18 175/57
2014/0367502 A1* 12/2014 Moeny ..... E21B 21/02 241/46.01
2016/0017663 A1* 1/2016 Moeny ..... E21B 17/003 175/327
2018/0209216 A1* 7/2018 Gilbrech ..... E21B 7/15
2018/0313158 A1 11/2018 Gilbrech
2019/0040685 A1* 2/2019 Moeny ..... E21C 37/18

FOREIGN PATENT DOCUMENTS

WO 2006/023998 3/2006
WO 2012/094676 7/2012
WO 2014/138045 9/2014
WO 2018/136033 7/2018

OTHER PUBLICATIONS

International Search Report, International Application No. PCT/US2020/0270042, dated Dec. 30, 2020, 5 pages.
Written Opinion, International Application No. PCT/US2020/0270042, dated Dec. 30, 2020, 4 pages.

* cited by examiner

*Primary Examiner* — David Carroll
(74) *Attorney, Agent, or Firm* — Benjamin Ford; Baker Botts L.L.P.

(57) ABSTRACT

A disclosed pulsed-power drill bit includes a bit body, an electrode coupled to the bit body and having a distal portion, a ground ring coupled to the bit body and having a distal portion for engaging with sidewall surfaces of a wellbore and defining an outer diameter of the ground ring, and actuatable, electrically conductive fins each coupled to the ground ring such that the fin and the distal portion of the ground ring are electrically continuous. Each fin is positioned such that when actuated, a distal portion of the fin is extended in a direction away from the bit body, increasing the effective outer diameter of the ground ring, or is retracted, decreasing the effective outer diameter of the ground ring. The fins may be spring loaded within a track, channel, or slot between fluid flow ports and may be actuated individually or collectively.

18 Claims, 8 Drawing Sheets

PULSED-POWER DRILL BIT GROUND RING WITH VARIABLE OUTER DIAMETER

TECHNICAL FIELD

The present disclosure relates generally to pulsed drilling operations and, more particularly, to systems and methods for varying the effective outer diameter of the ground ring of a pulsed-power drill bit.

BACKGROUND

Pulsed-power drilling may be used to form wellbores in subterranean rock formations for recovering hydrocarbons, such as oil and gas, from these formations. Electrocrushing drilling uses pulsed-power technology to fracture the rock formation by repeatedly delivering electrical arcs or high-energy shock waves to the rock formation. More specifically, a drill bit of a pulsed-power drilling (PPD) system is excited by a train of high-energy electrical pulses that produce high power discharges through the formation at the distal end of the drill bit. The discharges produced by the high-energy electrical pulses, in turn, fracture part of the formation proximate to the drill bit.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
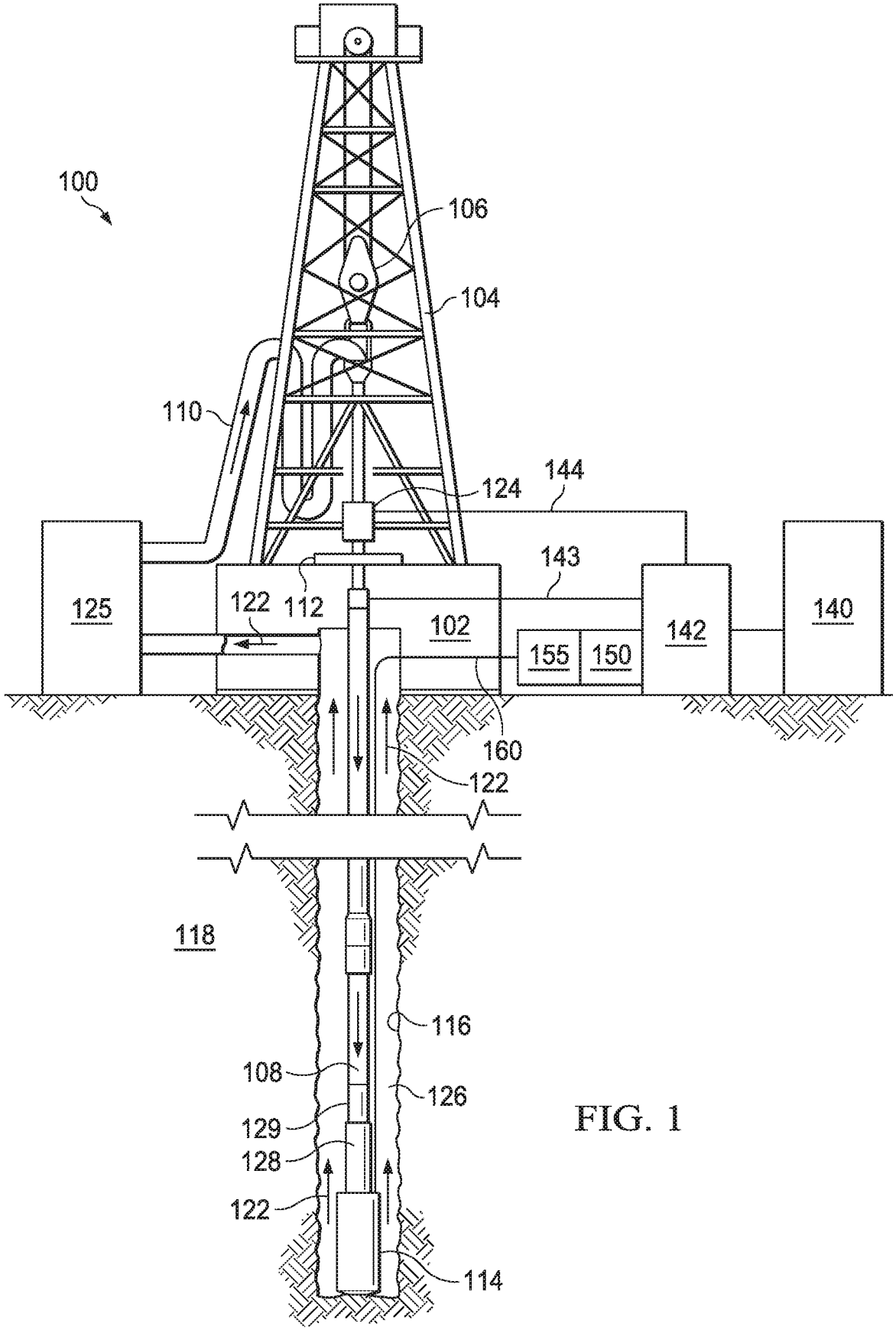
FIG. 1 is an elevation view of an example pulsed-power drilling (PPD) system used in a wellbore environment.

Aspects of this disclosure include a pulsed-power drill bit having a variable diameter ground ring that may be used to selectively increase or decrease the diameter of a wellbore during pulsed-power drilling. The effective outer diameter of the ground ring may be increased or decreased while the pulsed-power drill bit remains downhole in the wellbore, allowing drilling to continue following the change to the effective outer diameter of the ground ring. The ability to control the effective diameter of the ground ring in real time may reduce the number of times that all or a portion of the drill string is removed from the wellbore during pulsed-power drilling, which may improve the rate of penetration (ROP) that can be achieved. In some cases, the pulsed-power drill bit with variable diameter ground ring may be used to drill a wellbore that has a non-standard diameter or to drill a wellbore that has different diameters at different depths. In one example, the pulsed-power drill bit with variable diameter ground ring may be used to underream a wellbore in certain circumstances. In another example, the pulsed-power drill bit with variable diameter ground ring may be used to drill different wellbores, or portions thereof, to different diameters without having to replace the pulsed-power drill bit at the distal end of the drill string. Such a pulsed-power drill bit with variable diameter ground ring may be used in many other scenarios to increase or decrease the diameter of a wellbore during pulsed-power drilling.

A variable diameter ground ring may include, or be coupled to, one or more moving elements, referred to herein as "fins." Each fin may be actuatable and positioned such that when actuated, a distal portion of the fin is extended in a direction away from the bit body of the pulsed-power drill bit to create an effective outer diameter of the ground ring that is greater than the outer diameter of ground ring itself. The effective outer diameter of the ground ring may be controlled by extending and/or retracting various ones of the actuatable fins. For example, when all of the fins are in their retracted positions, the effective outer diameter of the ground ring may be a default diameter equal to the physical outer diameter of the ground ring itself. This may represent the minimum effective outer diameter for the ground ring, which may be used to drill a wellbore having the minimum diameter possible using the pulsed-power drill bit. The effective outer diameter of the ground ring may be increased by actuating one or more of the fins, extending them beyond the physical outer diameter of the ground ring itself and creating a circular effective outer diameter defined by the distal portions of the fins extending from the physical outer diameter of the ground ring. If the pulsed-power drill bit is operating with one or more of the fins extended, the effective outer diameter of the ground ring may be decreased by retracting one or more of the extended fins.

The fins may be made of an electrically conductive material and may be coupled to the ground ring such that they are electrically continuous with the ground ring. The fins, when actuated, form an extended surface of the electrode represented by the ground ring during pulsed-power drilling. For example, when a high electric potential is applied across the electrodes of the pulsed-power drill bit, including the ground ring, causing the surrounding rock to fracture, any fins that have been actuated to extend beyond the outer diameter of the ground ring provide respective contact points on the rock formation that cause a larger diameter hole to be drilled in the rock formation as the pulsed-power drill bit rotates. The fins may have any shape suitable for operation in the context in which they are used. In one example, the thickness of the fins, tangentially to the radius, may vary depending on the environment in which the pulsed-power drill bit is to operate. In one example, the leading edge of each fin, with respect to the direction of rotation of the pulsed-power drill bit, may be chamfered or curved to prevent the leading edge from catching on the sidewall surfaces of the wellbore while the pulsed-power drill bit is rotating. Similarly, the distal end of each fin may be chamfered or curved to prevent the distal end of the fin from catching on the sidewall surfaces of the wellbore during pulsed drilling operations.

A controller for a PPD system may automatically determine that the effective outer diameter of a pulsed-power drill bit ground ring should be increased for a particular pulsed drilling (PD) operation. In response to such a determination, the controller may also initiate the actuation of one or more actuatable, electrically conductive fins coupled to the distal portion of the ground ring such that the distal portion of the fin is extended in a direction away from the bit body proximate to the distal portion of the ground ring. A pulsed drilling controller (PDC) may receive and analyze feedback from various downhole and/or surface-based components reflecting conditions for a PD operation or a performance measurement associated with the PD operation to determine whether or when to initiate the actuation of one or more fins to create an effective outer diameter of the ground ring that is greater than the outer diameter of the ground ring itself and, in some cases, to increase the effective surface area of the distal portion of the ground ring that comes in contact with a rock formation on the sidewall surfaces of the wellbore.

If it is determined that one or more fins should be actuated, the PDC may output one or more control signals to initiate the actuation of one or more fins. Alternatively, one or both of determining that one or more fins should be actuated and initiating the actuation of the one or more fins may be performed by or under the direction of a person such as, for example, an engineer or equipment operator, in response to a current condition for a PD operation, a current drilling performance measurement associated with the PD operation, or a change in a condition or drilling performance measurement associated with the PD operation. For example, an engineer or equipment operator may provide input or issue a command to a PDC indicating that one or more fins should be actuated to effect a desired change to the diameter of the wellbore. In response, the PDC may output one or more control signals to cause the actuation. The PDC may subsequently disable the control signals to cause a retraction of any extended fins or may output one or more additional control signals to cause a retraction of any extended fins. In one example, if the fins are spring-loaded, disabling the actuation control signals may allow the fins to return to their retracted state without receiving an explicit retraction control signal.

A controller for a PPD system may automatically determine that the effective outer diameter of a pulsed-power drill bit ground ring should be decreased for a particular pulsed drilling (PD) operation. For example, subsequent to extending one or more of the fins beyond the outer diameter of the ground ring during a PD operation, the controller may determine that the effective outer diameter should be decreased. In response to such a determination, the controller may also initiate the actuation of one or more actuatable, electrically conductive fins coupled to the distal portion of the ground ring such that the distal portion of the fin is retracted in a direction toward the bit body proximate to the distal portion of the ground ring. A pulsed drilling controller (PDC) may receive and analyze feedback from various downhole and/or surface-based components reflecting conditions for a PD operation or a performance measurement associated with the PD operation to determine whether or when to initiate the actuation of one or more fins to create an effective outer diameter of the ground ring that is less than the current effective outer diameter of the ground ring.

If it is determined that one or more fins should be retracted, the PDC may output one or more control signals to initiate the retraction of the one or more fins. Alternatively, one or both of determining that one or more fins should be retracted and initiating the retraction of the one or more fins may be performed by or under the direction of a person such as, for example, an engineer or equipment operator, in response to a current condition for a PD operation, a current drilling performance measurement associated with the PD operation, or a change in a condition or drilling performance measurement associated with the PD operation. For example, an engineer or equipment operator may provide input or issue a command to a PDC indicating that one or more fins should be retracted to effect a desired change to the diameter of the wellbore. In response, the PDC may output one or more control signals to cause the retraction. In one example, if the fins are spring-loaded, disabling the actuation control signals that initiate the extension of the fins may allow the fins to return to their retracted state without receiving an explicit retraction control signal.

There are numerous ways in which the effective outer diameter of a pulsed-power drill bit ground may be increased or decreased during a PD operation. Thus, embodiments of the present disclosure and its advantages are best understood by referring to FIGS. 1 through 9, where like numbers are used to indicate like and corresponding parts.

FIG. 1 is an elevation view of an example PPD system used to form a wellbore in a subterranean formation. Although FIG. 1 shows land-based equipment, downhole tools incorporating teachings of the present disclosure may be satisfactorily used with equipment located on offshore platforms, drill ships, semi-submersibles, and drilling barges (not expressly shown). Additionally, while wellbore 116 is shown as being a generally vertical wellbore, wellbore 116 may be any orientation including directional (in which the wellbore may include an angled section off of vertical, or one or more slants and/or curves) or generally horizontal. The wellbore may be part of a complex wellbore architecture, such as a multilateral well.

PPD system 100 includes drilling platform 102 that supports derrick 104 having traveling block 106 for raising and lowering drill string 108. Drill string 108 may be raised and lowered using a draw-works, such as a machine on the rig including a large diameter spool (not shown) of wire rope. The draw-works may be driven by a power source of PPD system 100, such as an electric motor (not shown), or hydraulically to spool-in the wire rope to raise the drill string. PPD system 100 may also include pump 125, which circulates drilling fluid 122 (also called "mud") through a feed pipe to kelly 110, which in turn conveys drilling fluid 122 downhole through interior channels of drill string 108 and through one or more openings, or fluid flow ports, in pulsed-power drill bit 114. Drilling fluid 122 circulates back to the surface via annulus 126 formed between drill string 108 and the sidewalls of wellbore 116. Fractured portions of the formation (also called "cuttings") are carried to the surface by drilling fluid 122 to remove those fractured portions from wellbore 116. Drilling fluid 122 may have rheological properties for removing cuttings from wellbore 116. Drilling fluid 122 may also have electrical properties conducive to particular PD operations. Drilling fluid 122 may be or include oil-based fluids or water-based fluids, depending upon the particular pulsed-power drilling approach used. For example, drilling fluid 122 may be formulated to have high dielectric strength and a high dielectric constant, so as to direct electrical arcs into the formation rather than them being short circuited through drilling fluid 122.

Pulsed-power drill bit 114 is attached to the distal end of drill string 108 and may be an electrocrushing drill bit or an electrohydraulic drill bit. Power may be supplied to drill bit 114 from components downhole, components at the surface and/or a combination of components downhole and at the surface. For example, generator 140 may generate electrical power and provide that power to power-conditioning unit 142. Power-conditioning unit 142 may then transmit electrical energy downhole via surface cable 143 and a subsurface cable (not expressly shown in FIG. 1) contained within drill string 108 or attached to the outer wall of drill string 108. A pulse-generating (PG) circuit within BHA 128 may receive the electrical energy from power-conditioning unit 142 and may generate high-energy electrical pulses to drive drill bit 114. The high-energy electrical pulses may discharge through the rock formation and/or drilling fluid 122 and may provide information about the properties of the formation and/or drilling fluid 122. The PG circuit within BHA 128 may be located near drill bit 114.

The PPD systems described herein may generate multiple electrical arcs per second using a specified excitation current profile that causes a transient electrical arc to form an arc through the most conducting portion of the wellbore floor. The arc causes that portion of the distal end of the wellbore to disintegrate or fragment and be swept away by the flow of drilling fluid. As the most conductive portions of the wellbore floor are removed, subsequent electrical arcs may naturally seek the next most conductive portion.

The electrical pulses used for pulsed-power drilling may be generated using any of a variety of PG circuits including, but not limited to, circuits that include capacitive energy storage elements and circuits that include inductive energy storage elements. The PG circuit may include a power source input, including two input terminals, and a first capacitor coupled between the input terminals. The PG circuit may include a first inductor coupled between the input terminals with associated opening switch and a first capacitor coupled to the two ends of the inductor. The PG circuit may also include a switch, a transformer, and a second capacitor whose terminals are coupled to respective electrodes of drill bit 114. The switch may include a mechanical switch, a solid-state switch, a magnetic switch, a gas switch, or any other type of switch suitable to open and close the electrical path between the power source input and a first winding of the transformer. The transformer generates a current through a second winding when the switch is closed and current flows through first winding. The current through the second winding charges the second capacitor. As the voltage across the second capacitor increases, the voltage across the electrodes of the drill bit increases.

The PG circuit within BHA 128 may be utilized to repeatedly apply a large electric potential across the electrodes of drill bit 114. For example, the applied electric potential may be in the range of 150 kv to 300 kv or higher. In this example, the lower bound on the applied electric potential may correspond to a lower bound on pulsed current of 500 amps. In another example, the lower bound on the applied electric potential may be 80 kv, with a lower bound on pulsed current of 500 amps. In yet another example, the lower bound on the applied electric potential may be 60 kv, again with a lower bound on pulsed current of 500 amps. Each application of electric potential is referred to as a pulse. The high-energy electrical pulses generated by the PG circuit may be referred to as pulse drilling signals. When the electric potential across the electrodes of drill bit 114 is increased enough during a pulse to generate a sufficiently high electric field, an electrical arc forms through rock formation 118 at the distal end of wellbore 116. The arc temporarily forms an electrical coupling between the electrodes of drill bit 114, allowing electric current to flow through the arc inside a portion of the rock formation at the distal end of wellbore 116. The arc greatly increases the temperature and pressure of the portion of the rock formation through which the arc flows and the surrounding formation and materials. The temperature and pressure are sufficiently high to break the rock into small bits referred to as cuttings. This fractured rock is removed, typically by drilling fluid 122, which moves the fractured rock away from the electrodes and uphole. The terms "uphole" and "downhole" may be used to describe the location of various components of PPD system 100 relative to drill bit 114 or relative to the distal end of wellbore 116 shown in FIG. 1. For example, a first component described as uphole from a second component may be further away from drill bit 114 and/or the distal end of wellbore 116 than the second component. Similarly, a first component described as being downhole from a second component may be located closer to drill bit 114 and/or the distal end of wellbore 116 than the second component.

The electrical arc may also generate acoustic and/or electromagnetic waves that are transmitted within rock formation 118 and/or drilling fluid 122 and carry information about properties of the formation. Sensors placed within wellbore 116 and/or on the surface may record responses to high-energy electrical pulses, acoustic waves and/or electromagnetic waves.

Sensor analysis system (SAS) 150 may be one element of a measurement system that records measurements usable to characterize a PD operation in real time. SAS 150 may, during PD operations, receive measurements representing the recorded responses and may analyze the measurements to determine characteristics of rock formation 118 or for other purposes. PPD system 100 may also include mud pulse valve 129 downhole. The opening and closing of mud pulse valve 129 may be controlled to create pressure pulses in drilling fluid 122 that convey information to various components on the surface. In one example, an optical fiber may be positioned inside a portion of wellbore 116 and a distributed acoustic sensing subsystem may sense the pressure pulses based on changes in strain on the optical fiber and translate them into electrical signals that are provided to SAS 150, Other types of pressure sensing mechanisms at the surface may detect the pressure pulses and translate them into electrical signals that are provided to SAS 150. Pulsed drilling controller (PDC) 155 may determine that the effective outer diameter of a ground ring of pulsed-power drill bit 114 should be increased for a particular pulsed drilling (PD) operation based on the analysis performed by SAS 150. In response to such a determination, the controller may also initiate the actuation of one or more actuatable, electrically conductive fins coupled to the distal portion of the ground ring such that the distal portion of the fin is extended in a direction away from the bit body proximate to the distal portion of the ground ring. Pulsed drilling controller (PDC) 155 may determine that the effective outer diameter of a ground ring of pulsed-power drill bit 114 should be decreased for a particular pulsed drilling (PD) operation based on the analysis performed by SAS 150. In response to such a determination, the controller may also initiate the actuation of one or more actuatable, electrically conductive fins coupled to the distal portion of the ground ring such that the distal portion of the fin is retracted in a direction toward the bit body proximate to the distal portion of the ground ring. SAS 150 may be positioned at the surface for use with PPD system 100 as illustrated in FIG. 1, or at any other suitable location. PDC 155 may be positioned at the surface for use with PPD system 100 as illustrated in FIG. 1, or at any other suitable location. In one example, a determination that the effective outer diameter of a ground ring of pulsed-power drill bit 114 should be increased for a particular pulsed drilling (PD) operation may be based on a determination that the annular clearance, or the average annular clearance, between the wellbore 116 and the BHA 128 to which the pulsed-power drill bit 114 is attached exceeds a predetermined maximum annular clearance. In this example, actuation of one or more actuatable, electrically conductive fins coupled to the distal portion of the ground ring may be initiated automatically to decrease the annular clearance between the wellbore 116 and the BHA 128.

There are potentially many scenarios in which it may be beneficial to increase or decrease the effective outer diameter of the ground ring of a pulsed-power drill bit by extending or retracting one or more actuatable, electrically conductive fins, as described herein. In one example, the described techniques may be applied to perform an under-reaming operation in which a hole under the casing of a wellbore is opened up for any of a variety of purposes. In one example, the described techniques may be applied to perform a side tracking operation to intentionally deviate from the current wellbore with the intention of creating another. In one example, the described techniques may be applied to retract or reposition one or more fins to release the pulse-power drill bit if it becomes caught on a ledge or formation during a PD operation while the fins are in an extended position. In this example, changing the target points of the electrical arcs produced by the pulsed-power drill bit may allow the pulsed-power drill bit to break free. Using the described techniques may allow a single pulsed-power drill bit to be used for multiple casing. For example, for hole integrity, the diameter of a wellbore may get smaller and smaller the closer the pulsed-power drill bit gets to the target zone. In this example, using a pulsed-power drill bit having a ground ring with a variable effective outer diameter may allow the pulsed-power drill bit to drill each successively smaller hole size without having to remove the pulsed-power drill bit and the entire drill string, saving the time and the costs associated with removing and replacing the drill bit.

Figure 9:
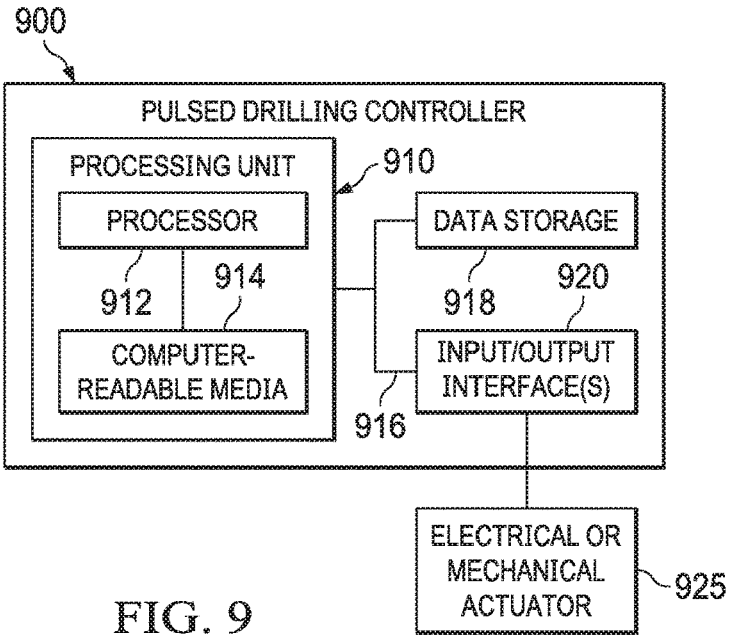
FIG. 9 is a block diagram illustrating an example pulsed drilling controller.

PDC 155 may be coupled to, or otherwise in communication with, SAS 150. Alternatively, the functionality of SAS 150 may be integrated within PDC 155, with PDC 155 acting as a master controller for PD operations. An example PDC that includes an integrated SAS is illustrated in FIG. 9 and described below. Signal or informational inputs to PDC 155 may include measurements received from both downhole and surface sensors, or results of calculations made based on those measurements, indicating ROP, characteristics of cuttings, characteristics of drilling fluid 122 returning from downhole to the surface and/or entrained gas; downhole measurements of wellbore diameter, caliper, or hole quality, vibration, or other wellbore characteristics; formation measurements; fluid pressure measurements; wellbore direction measurements; wellbore tortuosity or dogleg severity; and measurements of parameters within the pulsed-power tool itself, such as power draw, voltages, currents, frequencies, or wave forms measured within the tool at various sensing points, some of which may be associated with one or more particular electronic components. Inputs to PDC 155 may include modeled or otherwise calculated targets for one or more operating parameters of a PD operation. Inputs to PDC 155 may include user specified target values for one or more operating parameters of a PD operation.

A variety of types of telemetry systems may be suitable for use in communicating commands from the surface to downhole components of PPD system 100 ("downlinks") and for communicating data from downhole components of PPD system 100 or other BHA elements to the surface ("uplinks"). Telemetry mechanism 160 illustrated in FIG. 1 may represent uplinks and/or downlinks associated with any suitable telemetry system. In some example PPD systems 100, one type of telemetry system may be used for downlinks and another type of telemetry system may be used for uplinks. In some example PPD systems 100, a single type of telemetry may be used for both downlinks and uplinks. In some example PPD systems 100, telemetry may be provided in only one direction (e.g., for downlinks or uplinks, but not both). In some example PPD systems 100, one type of telemetry may be used for a portion of the travel path of the uplinks and/or downlinks, and another type of telemetry may be used for another portion of the travel path of the uplinks and/or downlinks, with suitable couplers being included at the interface between the two portions of the travel path. For example, any suitable telemetry mechanism 160 may be used for communicating signals between downhole components, including drill bit 114 and/or various downhole sensors, and surface-based components, including SAS 150 and/or PDC 155.

In one example, telemetry mechanism 160 may be used for exchanging information by communicating acoustic, electrical or electromagnetic signals to or from PDC 155 during a PD operation. More specifically, one or more input/output interfaces of PDC 155 may be configured for communication to or from various electrical, mechanical, pneumatic, or hydraulic components located downhole during a PD operation, such as one or more actuators configured to extend various actuatable, electrically conductive fins of a variable diameter ground ring of a pulsed-power drill bit 114 when actuated. In one example, telemetry mechanism 160 may be used for communicating signals from various acoustic, electrical or electromagnetic sensors at the surface or downhole to SAS 150 during a PD operation.

Telemetry mechanism 160 may include an optical fiber that extends downhole in wellbore 116 and that is coupled to SAS 150 and/or to PDC 155. The optical fiber may be enclosed within a cable, rope, line, or wire. More specifically, the optical fiber may be enclosed within a slickline, a wireline, coiled tubing, or another suitable conveyance for suspending a downhole tool in wellbore 116. The optical fiber may be charged by a laser to provide power to PDC 155, SAS 150, or sensors located within wellbore 116. More specifically, one or more input/output interfaces of SAS 150 may be coupled to the optical fiber for communication to and from acoustic, electrical or electromagnetic sensors positioned downhole. For example, the sensors may transmit measurements to SAS 150. Any suitable number of SASs 150, each of which may be coupled to an optical fiber located downhole, may be placed inside or adjacent to wellbore 116. Mud pulse telemetry systems may be employed for uplinks and/or downlinks. For example, PPD system 100 may include valve 124 at the surface. The opening and closing of valve 124 may be controlled to create pressure pulses, sometimes referred to as mud pulses, in drilling fluid 122 that convey commands or other information to various downhole components. The pressure pulses, or mud pulses, may be sensed by a sensor at the BHA, e.g., a pressure sensor ported to the flow path of drilling fluid 122 through the BHA tubular elements. The resulting sensor signals may inform or be translated (e.g., by a processor) into commands used in controlling a PD operation. For example, the resulting sensor signals may be translated into control signals used to control one or more actuators configured to extend respective actuatable, electrically conductive fins of a variable diameter ground ring of a pulsed-power drill bit 114 when actuated.

Acoustic telemetry may be employed for uplinks and/or downlinks. For example, piezo or other devices may be coupled to drill string 108 at or near one end to create acoustic signals that travel along drill string 108, and other piezo or other devices may be coupled to drill string 108 at or near the opposite end of drill string 108 to receive the acoustic signals. Repeaters may be employed along drill string 108 to receive and re-launch the acoustic signals. The resulting sensor signals may be translated into other types of control signals used to control a PD operation. For example, the resulting sensor signals may be translated into control signals used to control one or more actuators configured to extend respective actuatable, electrically conductive fins of a variable diameter ground ring of a pulsed-power drill bit 114 when actuated.

Electromagnetic (EM) telemetry may be employed for uplinks and/or downlinks. EM telemetry systems may utilize a relatively low frequency (e.g., 1 to 100 Hz) signal created using an antenna subsystem with an insulative gap in the BHA to communicate an electromagnetic signal from a location downhole to the surface. Drill string 108 and its casing may serve as one conductor and the formation may serve as the other conductor. The EM signal may be sensed at the surface by measuring voltage and/or current between the drill string casing or other connected conductive elements at the surface and an electrode coupled to the formation. An EM signal may be communicated from the surface to downlink by applying a low frequency signal between the two surface contact points, and may be sensed downhole by measuring voltage and/or current across the insulative gap of the antenna sub. The resulting sensor signals may be translated into other types of control signals used to control a PD operation. For example, the resulting sensor signals may be translated into control signals used to control one or more actuators configured to extend respective actuatable, electrically conductive fins of a variable diameter ground ring of a pulsed-power drill bit 114 when actuated.

Uplinks and downlinks may be provided by a wire conveyed between the surface and one or more downhole components. Suitable implementations of this approach include running a wireline down the center of or along the outside of drill string 108. A wired pipe approach may utilize wire that is integral with the drill pipe and inductive couplings between sections of drill pipe. This wired pipe approach may be used for uplinks and/or downlinks. The resulting sensor signals may be translated into other types of control signals used to control a PD operation. For example, the resulting sensor signals may be translated into control signals used to control one or more actuators configured to extend respective actuatable, electrically conductive fins of a variable diameter ground ring of a pulsed-power drill bit 114 when actuated.

Wellbore 116, which penetrates various subterranean rock formations 118, is created as drill bit 114 repeatedly fractures the rock formation and drilling fluid 122 moves the fractured rock uphole. Wellbore 116 may be any hole formed in a subterranean formation or series of subterranean formations for the purpose of exploration or extraction of natural resources such as, for example, hydrocarbons, or for the purpose of injection of fluids such as, for example, water, wastewater, brine, or water mixed with other fluids. Additionally, wellbore 116 may be any hole formed in a subterranean formation or series of subterranean formations for the purpose of geothermal power generation.

Although pulsed-power drill bit 114 is described above as implementing electrocrushing drilling, pulsed-power drill bit 114 may also be used for electrohydraulic drilling. In electrohydraulic drilling, rather than generating an electrical arc within the rock, drill bit 114 applies a large electrical potential across the one or more electrodes to form an arc across the drilling fluid proximate to the distal end of wellbore 116. The high temperature of the arc vaporizes the portion of the drilling fluid immediately surrounding the arc, which in turn generates a high-energy shock wave in the remaining fluid. The electrodes of electrohydraulic drill bit may be oriented such that the shock wave generated by the arc is transmitted toward the distal end of wellbore 116. When the shock wave contacts and bounces off of the rock at the distal end of wellbore 116, the rock fractures. Accordingly, wellbore 116 may be formed in subterranean formation 118 using drill bit 114 that implements either electrocrushing or electrohydraulic drilling. The circuit topologies used for electrohydraulic drilling may be the same as, or similar to, those used for electrocrushing drilling with at least some components of the circuits having different values.

Figure 2:
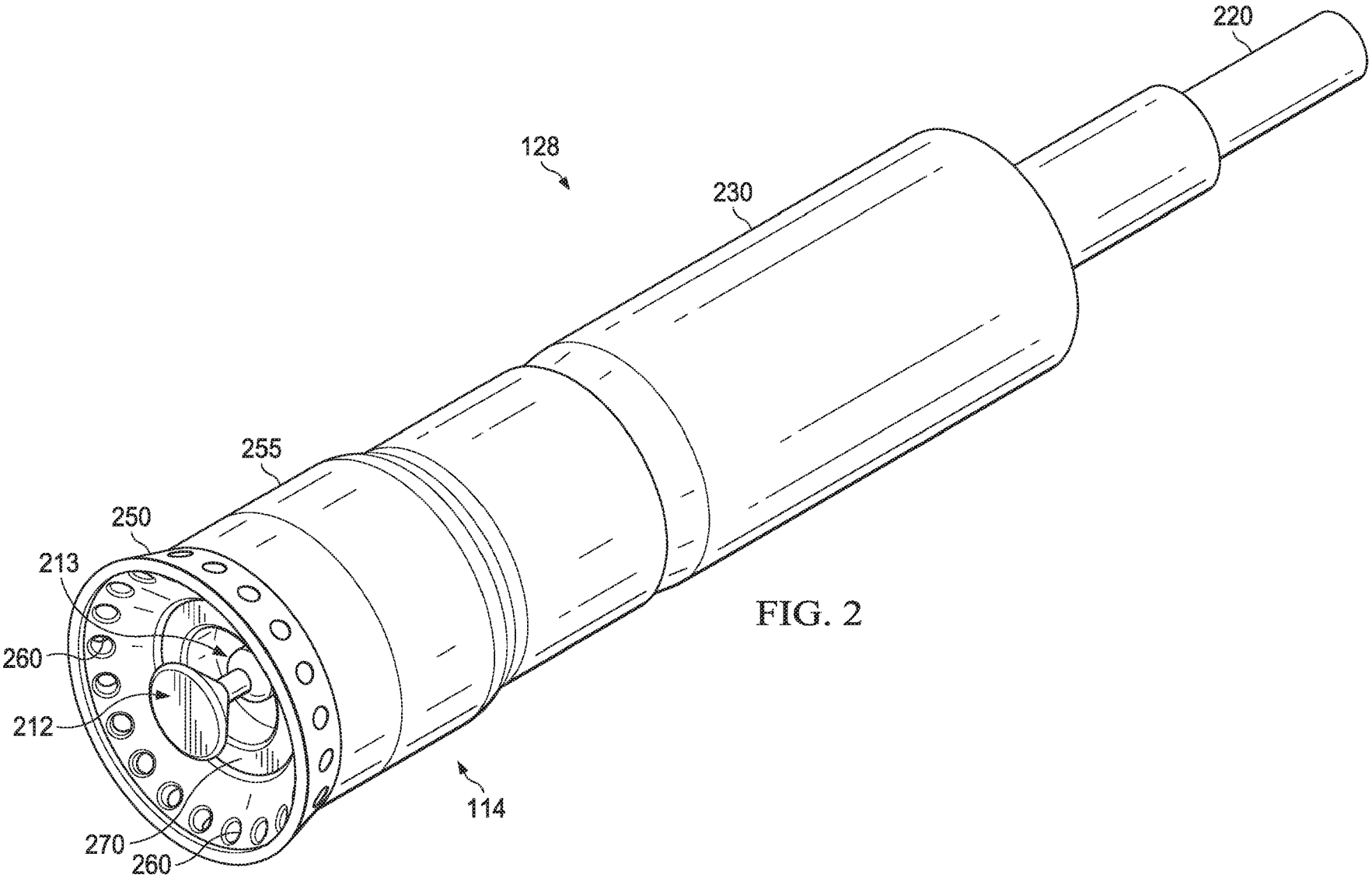
FIG. 2 is a perspective view of example components of a bottom-hole assembly (BHA) for a PPD system.

FIG. 2 is a perspective view of example components of a bottom-hole assembly (BHA) for a PPD system. BHA 128 may include pulsed-power tool 230 and drill bit 114. For the purposes of the present disclosure, drill bit 114 may be integrated within BHA 128, or may be a separate component that is coupled to BHA 128. Drill bit 114 may include bit body 255, electrode 212, ground ring 250, and solid insulator 270. Although illustrated as a contiguous ring in FIG. 2, ground ring 250 may include non-contiguous discrete electrodes and/or may be implemented in different shapes.

Pulsed-power tool 230 may provide pulsed electrical energy to drill bit 114. Pulsed-power tool 230 receives electrical power from a power source via cable 220. For example, pulsed-power tool 230 may receive electrical power via cable 220 from a power source of the PPD system located on the surface as described above with reference to FIG. 1, or from a power source located downhole such as a generator powered by a mud turbine. Pulsed-power tool 230 may also receive electrical power via a combination of a power source located on the surface and a power source located downhole. Pulsed-power tool 230 converts electrical power received from the power source into pulse drilling signals in the form of high-energy electrical pulses that are applied across electrode 212 and ground ring 250 of drill bit 114. Pulsed-power tool 230 may include a PG circuit as described above with reference to FIG. 1.

Electrode 212 may be placed approximately in the center of drill bit 114. Electrode 212 may be positioned at a minimum distance from ground ring 250 of approximately 0.4 inches and at a maximum distance from ground ring 250 of approximately 6 inches. The distance between electrode 212 and ground ring 250 may be based on the parameters of the PD operation and/or on the diameter of drill bit 114. For example, the distance between electrode 212 and ground ring 250, at their closest spacing, may be at least 0.4 inches, at least 1 inch, at least 1.5 inches, or at least 2 inches. The distance between electrode 212 and ground ring 250 may be generally symmetrical or may be asymmetrical such that the electric field surrounding the drill bit has a symmetrical or asymmetrical shape. The distance between electrode 212 and ground ring 250 allows drilling fluid 122 to flow between electrode 212 and ground ring 250 to remove vaporization bubbles from the drilling area. Electrode 212 may have any suitable diameter based on the PD operation, the distance between electrode 212 and ground ring 250, and/or the diameter of drill bit 114. For example, electrode 212 may have a diameter between approximately 2 and approximately 10 inches. Ground ring 250 may function as an electrode and provide a location on the drill bit where an electrical arc may initiate and/or terminate. During a PD operation, the electrode 212 and ground ring 250 may have opposite polarities to create electric field conditions such that arcs initiate at the electrode 212 and terminate on the ground ring 250 or vice versa such that the arcs initiate at ground ring 250 and terminate on the electrode 212. For example, the electrode 212 may have a positive polarity while ground ring 250 has a negative polarity.

Drill bit 114 may include one or more openings, or fluid flow ports, on the face of the drill bit through which drilling fluid exits the drill string 108. For example, ground ring 250 of drill bit 114 may include one or more fluid flow ports 260 such that drilling fluid 122 flows through fluid flow ports 260 carrying fractured rock and vaporization bubbles away from the drilling area. Fluid flow ports 260 may be simple holes, or they may be nozzles or other shaped features. Drilling fluid 122 is typically circulated through PPD system 100 at a flow rate sufficient to remove fractured rock from the vicinity of drill bit 114. In addition, drilling fluid 122 may be under sufficient pressure at a location in wellbore 116, particularly a location near a hydrocarbon, gas, water, or other deposit, to prevent a blowout. Drilling fluid 122 may exit drill string 108 via opening 213 surrounding electrode 212. The flow of drilling fluid 122 out of opening 213 allows electrode 212 to be insulated by the drilling fluid. Because fines are not typically generated during pulsed-power drilling, as opposed to mechanical drilling, drilling fluid 122 might not need to exit the drill bit with as high a pressure drop as is typical for the drilling fluid in mechanical drilling. As a result, nozzles and other features used to increase drilling fluid velocity may not be needed on drill bit 114. However, nozzles or other features to increase the velocity of drilling fluid 122 or to direct drilling fluid 122 may be included for some uses. Additionally, the shape of solid insulator 270 may be selected to enhance the flow of drilling fluid 122 around the components of drill bit 114.

As described above with reference to FIGS. 1 and 2, when the electric potential across electrodes of a pulsed-power drill bit 114 becomes sufficiently large, an electrical arc forms through the rock formation and/or drilling fluid 122 that is near the electrodes. The arc provides a temporary electrical short between the electrodes, and thus allows electric current to flow through the arc inside a portion of the rock formation 118 and/or drilling fluid 122 at the distal end of the wellbore. The arc increases the temperature of the portion of the rock formation through which the arc flows and the surrounding formation and materials. The temperature is sufficiently high to vaporize any water or other fluids that might be proximate to the arc and may also vaporize part of the rock. The vaporization process creates a high-pressure gas and/or plasma which expands and, in turn, fractures the surrounding rock.

PPD systems and pulsed-power tools may utilize any suitable PG circuit topology to generate and apply high-energy electrical pulses across electrodes within the pulsed-power drill bit 114. Such PG circuit topologies may utilize electrical resonance to generate the high-energy electrical pulses required for pulsed-power drilling. The PG circuit may be shaped and sized to fit within the circular cross-section of pulsed-power tool 230, which as described above with reference to FIG. 2, may form part of BHA 128. The PG circuit and its electronic components may be enclosed within an encapsulant, which may help maintain mechanical stability under shock and vibration. The encapsulant may be made of a thermally conductive material that helps transfer heat away from the PG circuit and its electronic components to protect the PG circuit and other components from damage due to the combination of self-generated heat and the heat of the ambient downhole environment. The downhole environment may include a wide range of temperatures. For example, the temperature within the wellbore may range from approximately 10 to approximately 300 degrees Centigrade.

As described herein, a PDC, such as PDC 155 may, based on results of an analysis by a SAS, such as SAS 150, or other inputs, determine that the effective outer diameter of a ground ring 250 of a pulsed-power drill bit should be increased or decreased for a PD operation. In response to such a determination, PDC 155 may output one or more control signals to initiate the actuation of one or more actuatable, electrically conductive fins coupled to the ground ring 250. The fins may be extended or retracted by push or pull rods, pneumatics, hydraulics, or other linkage mechanisms, with or without biasing (e.g., springs), that are coupled to an actuation mechanism, such as those described herein. In one example, an actuator may be or include a mandrel that, when actuated, moves in a downhole direction, applying a force on each of the actuatable, electrically conductive fins to guide the fin into an extended position.

Figure 3A:
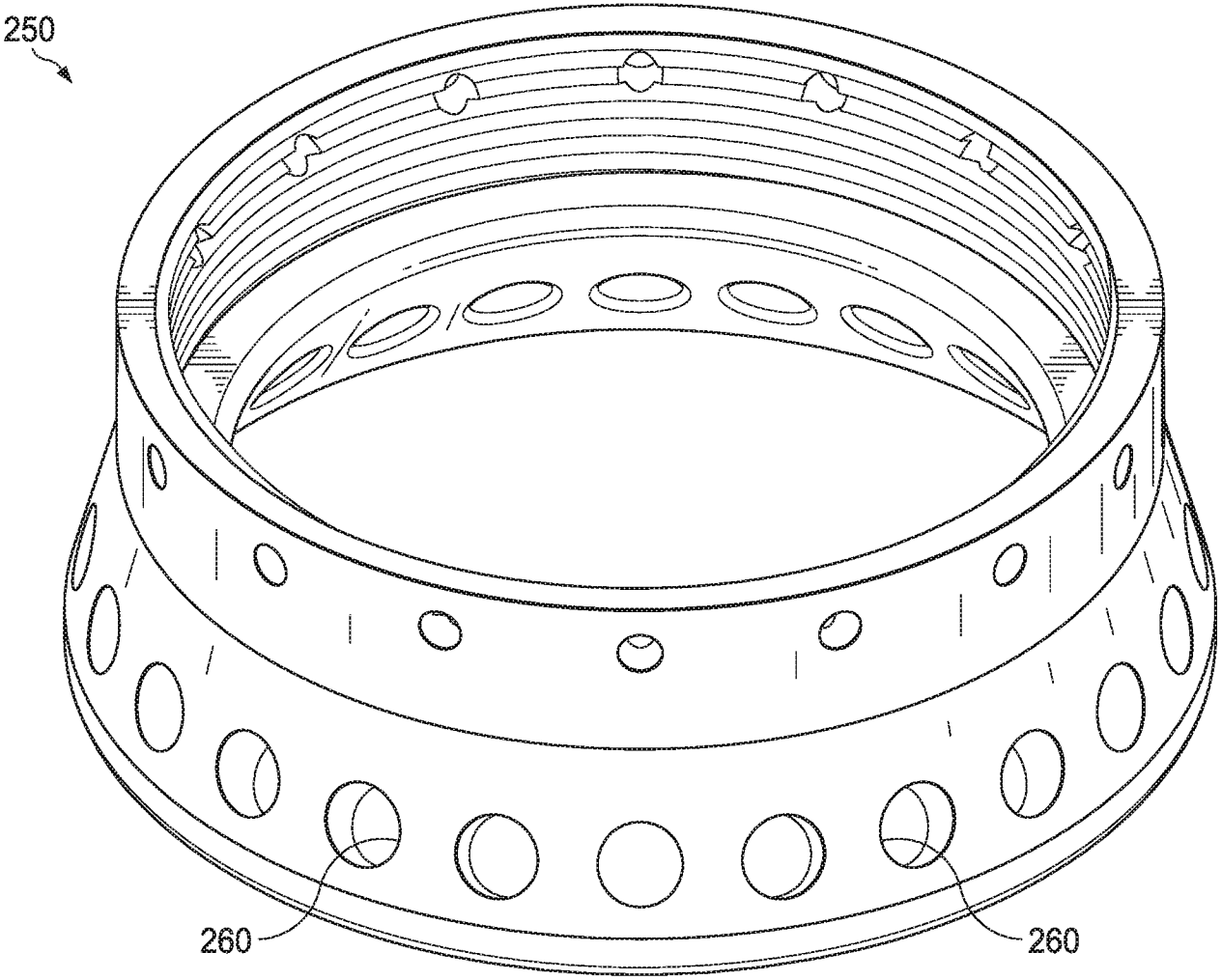
FIG. 3A is a perspective view of an example ground ring for a downhole pulsed-power drill bit.
Figure 3B:
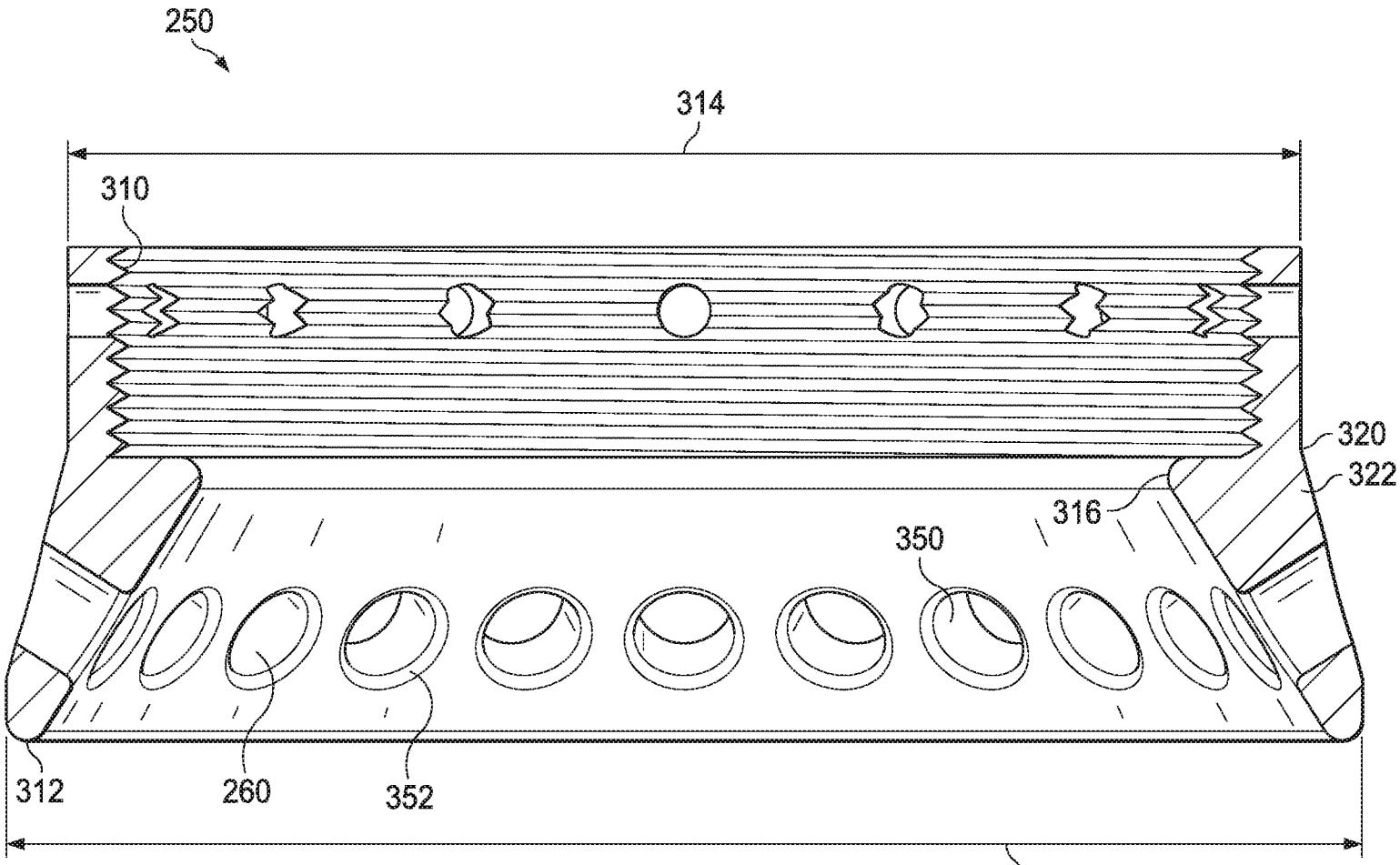
FIG. 3B is a cross-sectional view of the ground ring shown in FIG. 3A.

FIG. 3A is a perspective view of an example ground ring for a downhole pulsed-power drill bit, such as pulsed-power drill bit 114 illustrated in FIGS. 1 and 2. FIG. 3B is a cross-sectional view of the ground ring shown in FIG. 3A. Ground ring 250 provides a similar function and has similar features as ground ring 250 shown in FIG. 2.

The shape of ground ring 250 may be selected to change the shape of the electric field surrounding the pulsed-power drill bit 114 during pulsed-power drilling. For example, the electric field surrounding the pulsed-power drill bit 114 may be designed so that the arc initiates at an electrode and terminates on ground ring 250 or vice versa such that the arc initiates from ground ring 250 and terminates on the electrode. The electric field changes based on the shape of the contours of the edges of ground ring 250. For example, downhole edge 312 may have a sharp radius of curvature such that the electric field conditions at downhole edge 312 are favorable for arc initiation and/or termination. Additionally, downhole edge 312 may be a distal portion of ground ring 250 that engages with a portion of the wellbore, such as wellbore 116 shown in FIG. 1. Curve 316 on the inner perimeter of ground ring 250 may have a gentle radius of curvature to such that the electric field conditions at curve 316 are not favorable for arc initiation and/or termination. A radius of curvature of a transition is the radius of a circle of which the arc of the transition is a part. By way of example, a sharp radius of curvature may be a radius in the range of approximately 0.05 to approximately 0.15 inches, such as approximately 0.094 inches, and a gentle radius of curvature may be a radius in the range of approximately 0.20 to approximately 1.0 inches or more, such as approximately 1.0 inches or more, such as approximately 0.25 inches, approximately 0.5 inches, approximately 0.75 inches, or approximately 1.0 inches. The gentle radius may be determined based on the geometry of the surrounding structures on pulsed-power drill bit 114 and the shape of the electric field for a given PD operation. For example, the electric fields on electrode 212 may be a function of the geometry of ground ring 250 and the geometry and material of insulator 270. For example, the radius of the edge of electrode 212 and the shape of electrode 212 may affect the interaction of pulsed-power drill bit 114 with the rock. Additionally, the structure of ground ring 250 may be adjusted to change the electric field distribution on electrode 212. Further, the material used to form insulator 270 and the configuration of insulator 270 may be adjusted to change the electric field on electrode 212. In some examples, the dielectric constant of the drilling fluid 122 and the geometry of the rock fragments and the wellbore 116 during the drilling process may affect the instantaneous electric field distribution on electrode 212. The features on ground ring 250 having a sharp radius of curvature may have the same or different sharp radius as features on the electrode having a sharp radius of curvature.

Ground ring 250 may include one or more opening, or fluid flow ports, 260 on the outer perimeter of ground ring 250 to direct drilling fluid 122 from around an electrode, out of the drilling field, and uphole to clear debris from the drilling field. The number and placement of fluid flow ports 260 may be determined based on the flow requirements of the PD operation. For example, the number and/or size of fluid flow ports 260 may be increased to provide a faster fluid flow rate and/or larger fluid flow volume. Edge 352 of each fluid flow port 260 may have a gentle radius of curvature such that the electric field conditions at edge 352 of each fluid flow port 260 are not favorable for arc initiation and/or termination.

Ground ring 250 may be manufactured from any material that can withstand the conditions in a wellbore and support the downforce from the uphole drilling components, such as steel in the 41 family (often designated as the 41xx family, for example 4140 steel), carbon alloyed steel, stainless steel, nickel and nickel alloys, copper and copper alloys, titanium and titanium alloys, chromium and chromium alloys, molybdenum and molybdenum alloys, doped ceramics, and combinations thereof. As described with respect to electrode 212, when an arc initiates or terminates at ground ring 250, the temperature at the initiation or termination point increases such that the temperature melts the surface of ground ring 250. When the shock wave hits the melted surface of ground ring 250, a portion of the melted surface may separate from the remainder of ground ring 250 and be carried uphole with the drilling fluid 122. Therefore, to prevent material loss, the areas of ground ring 250 having electric field conditions favorable to arc initiation and/or termination may be coated with or made from a metal matrix composite.

Ground ring 250 may further include threads 310 along the inner diameter 314 of ground ring 250. Threads 310 may engage with corresponding threads on a portion of a pulsed-power drill bit 114 such that ground ring 250 is replaceable during operation. For example, ground ring 250 may be replaced if ground ring 250 is damaged by erosion or fatigue during a PD operation.

The thickness of wall 322 of ground ring 250 may be based on the diameter of ground ring 250 and/or the weight of the uphole components of the pulsed-power drilling system that are exerting downforce on ground ring 250. For example, the thickness of wall 322 may range from approximately 0.25 inches to approximately 2 inches. The thickness of wall 322 may be based on the diameter of ground ring 250 such that the thickness of wall 322 increases as the diameter of ground ring 250 increases. Additionally, the thickness of wall 322 may taper such that the thickness is the smallest at downhole edge 312 and the largest between curve 320 and curve 316. For example, the thickness of wall 322 may be approximately 0.3 inches at downhole edge 312 and increase to approximately 0.8 inches between curve 320 and curve 316. The tapering of the thickness of wall 322 may provide annular clearance for the flow of drilling fluid 122 to clear debris from between a BHA to which the pulsed-power drill bit 114 is attached, such as BHA 128 illustrated in FIGS. 1 and 2, and the inner wall of the wellbore 116.

Outer diameter 318 of ground ring 250 may be selected based on the diameter of the wellbore and the annular clearance between the wellbore 116 and the BHA 128 to which the pulsed-power drill bit 114 is attached. The diameter of the electrode 212 contained within ground ring 250 on the pulsed-power drill bit 114 may be selected for drilling a particular type of formation. For example, the diameter of the electrode 212 may be selected to optimize the electric field surrounding the pulsed-power drill bit 114 and provide flow space for drilling fluid 122. Ground ring 250 may have an outer diameter 318 equal to the gauge of the wellbore 116 to be drilled by the pulsed-power drill bit 114 or may have an outer diameter 318 slightly smaller than the gauge of the wellbore 116 to be drilled. For example, the outer diameter 318 of ground ring 250 may be at least 0.03 inches or at least 0.5 inches smaller than the gauge of the wellbore 116 to be drilled. In some examples, ground ring 250 may have features on the inner diameter 314 of ground ring 250, such as curve 316, that have a gentle radius while features on the outer diameter 318 of ground ring 250, such as curve 320, may have a sharp radius such that the pulsed-power drill bit 114 creates an overgauged wellbore during a PD operation.

Ground ring 250 illustrated in FIGS. 2, 3A, and 3B may be a variable diameter ground ring that includes, or is coupled to, one or more actuatable, electrically conductive fins that, when actuated, increase or decrease the effective outer diameter of ground ring 250. By controlling the effective outer diameter of ground ring 250 during a PD operation, including when the PPD system is operating in an over gauge or under gauge condition, the diameter or caliper of the wellbore may also be controlled.

During PD operations, high-energy electrical pulses are applied to the electrodes of drill bit 114 to build up electric charge at the electrodes. The rock in the surrounding formation fractures when an electrical arc forms at drill bit 114. Electromagnetic waves are created by the current associated with the electrical arc and/or the electric charge built up on the electrodes of drill bit 114. In addition, acoustic waves are created by the electrical arc and subsequent fracturing of rock in the formation proximate to the drill bit. Electromagnetic waves and/or acoustic waves may originate from and/or in proximity to drill bit 114 at the distal end of wellbore 116 and propagate in any direction.

PPD system may include any number of sensors of any suitable type to detect, receive, and/or measure an electric and/or magnetic field. The sensors may include any type of sensor that records responses from electromagnetic and/or acoustic waves. Any number of acoustic sensors suitable to measure, map, and/or image subterranean features may be positioned at one or more locations on the surface or elsewhere. For example, an array of acoustic sensors may be used within the wellbore. The acoustic sensors in the array may be positioned at different locations within the wellbore and may be oriented in different directions to record responses to propagating acoustic waves. The array may provide information about the surrounding formation at various depths sufficient for SAS 150 to identify surrounding subterranean features.

SAS 150 may receive data from one or more sensors via corresponding interfaces. Each sensor may provide differential or single-ended measurement data to SAS 150 via a corresponding interface. During PD operations, electromagnetic waves created by pulses generated at drill bit 114 may propagate through one or more subterranean layers before reaching the surface. Acoustic waves may propagate uphole along wellbore 116 from drill bit 114 to the surface and travel through one or more subterranean layers of formation 118. One or more of the sensors may be located in wellbore 116 and/or on the surface. The sensors may be located a known distance from drill bit 114. The sensors may record responses to received signals including, but not limited to, pulse drilling signals in the form of high-energy electrical pulses, electromagnetic waves and/or acoustic waves created during PD operations. The sensors may convert the recorded responses into measurements and may send one or more measurements representing the recorded responses to SAS 150, which analyzes the measurement data. One or more components of SAS 150 may be located on the surface, in wellbore 116, and/or at a remote location. For example, SAS 150 may include a measurement processing subsystem in wellbore 116 that processes measurements provided by one or more of the sensors and transmits the results of the processing uphole to PDC 155 or to another component of SAS 150 for storage and/or further processing. The measurements may be digital representations of the recorded responses. The measurements may be represented in the time domain or the frequency domain. In the time-domain, sensors may measure electromagnetic waves by determining a voltage or current and may measure acoustic waves by determining a pressure or displacement. In the frequency domain, a sensor may measure the amplitude and phase by recording responses to the received signal, such as a steady state monochromatic signal, or by performing a Fourier transform of the signal, such as a wide band signal. Measurements made by the sensors may be analyzed by SAS 150 to evaluate the formation 118 ahead of drill bit 114, which may inform a determination of whether or when to actuate one or more actuatable, electrically conductive fins of a variable diameter ground ring of a pulsed-power drill bit 114 when actuated.

SAS 150 may process measurements received from various sensors to determine characteristics of the surrounding formation 118 and to generate predictions about the formation layers downhole from drill bit 114. The data collected by various acoustic, electric or electromagnetics sensors or sensor arrays may be used to optimize the drilling process. For example, a PDC, such as PDC 155 illustrated in FIG. 1, may use raw data collected by SAS 150 and/or the results of analyses performed by SAS 150 to determine whether or when to actuate one or more actuatable, electrically conductive fins to increase or decrease the effective outer diameter of ground ring 250 and meet the operational goals of the PD operation based on characteristics of the formation 118 that are determined using the sensor data. The actuation of one or more fins for a particular PD operation may be initiated in response to an evaluation of the actual or predicted formation layers ahead of the drilling tool (e.g., based on an analysis of sensor data or a formation layer predication) and/or on an analysis of the cuttings. The actuation may be initiated by an operator at the surface such as, for example, a human, or a computer-based control system at the surface or downhole. For example, an engineer or equipment operator may provide input or issue a command to a PDC indicating that one or more actuatable, electrically conductive fins of a variable diameter ground ring should be actuated. In response, the PDC may output a control signal to cause the actuation. In one example, a control algorithm executing on PDC 155, with or without operator intermediation, may be used to initiate actuation of a particular fin or fins during a PD operation to optimize a drilling plan without having to remove the drill bit 114 from the wellbore.

A person or processor may initiate actuation of particular actuatable, electrically conductive fins of the ground ring based on drilling performance measurements from sensors in the wellbore that inform the determination of the actuations to be made. The sensors may be integrated in the pulsed-power tool or may be separate sensors within the BHA, such as within a measurement while drilling (MWD) system or a formation evaluation while drilling (FEWD) system. The drilling performance measurements may include, without limitation, directional measurements indicative of the wellbore's azimuth, inclination, and/or toolface orientation; wellbore caliper measurements; wellbore roughness or smoothness measurements; or measurements from formation evaluation sensors, including sensors for natural gamma rays, resistivity, neutron porosity, density, acoustic, or other parameters of interest. Sensors at the surface may be used to measure surface pressures, ROP of the drill string, and/or various parameters associated with the returns from downhole and/or with properties of the returned drilling fluid. Analyzing the cuttings or obtaining some of the measurements described herein may be performed by an operator (e.g., mud logger) and may be quantitative or qualitative, absolute or relative.

Drilling performance measurements may be indicative of the drilling performance goals for and/or performance results of a particular PD operation, and may be affected, directly or indirectly, by changing the effective outer diameter of the ground ring of a pulsed-power drill bit. Making changes to the effective outer diameter of the ground ring may result in changes to, and may be reflected in changed measurements associated with, the average ROP for the wellbore; the ability to penetrate, and the ROP of, particular formations encountered while drilling the wellbore; the gauge of the wellbore; and/or the quality (e.g., roughness or smoothness) of the wellbore sidewall surfaces, among other performance measurements.

Figure 4:
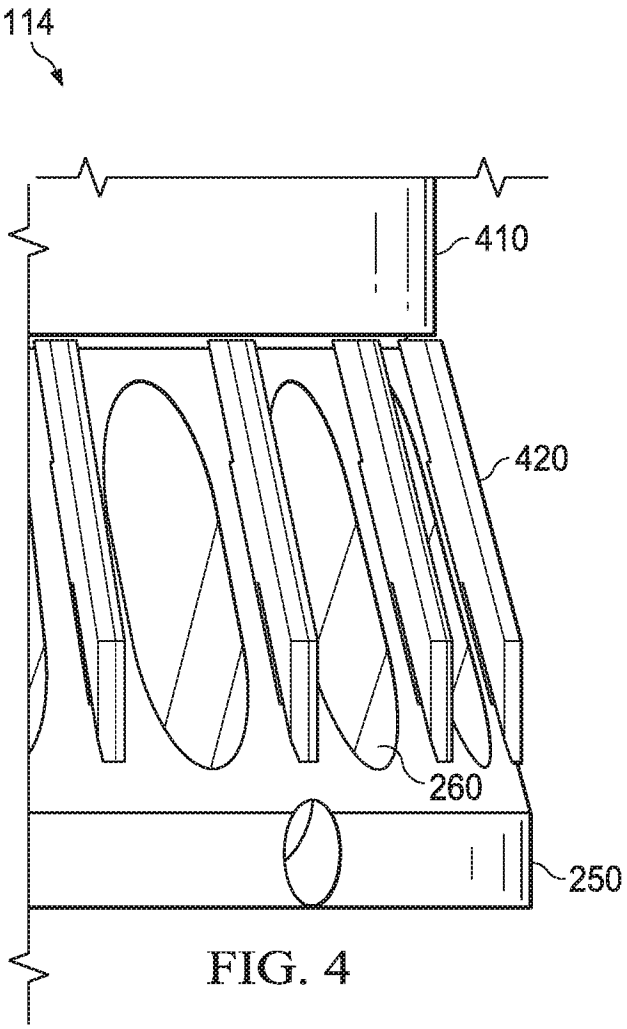
FIG. 4 is a perspective view of components of an example pulsed-power drill bit including a variable diameter ground ring.

FIG. 4 is a perspective view of components of an example pulsed-power drill bit including a variable diameter ground ring. In the illustrated example, pulsed-power drill bit 114 includes a variable diameter ground ring 250, multiple actuatable, electrically conductive fins 420, and an actuator 410. Ground ring 250 may be coupled to a bit body of pulsed-power drill bit 114 proximate to an electrode (not shown in FIG. 4) and have a distal portion for engaging with a sidewall surface of a wellbore. The electrode and ground ring 250 may be positioned in relation to each other such that an electric field produced by a voltage applied between ground ring 250 and the electrode is enhanced at a portion of the electrode proximate to the distal portion of the electrode and at a portion of ground ring 250 proximate to the distal portion of the ground ring 250. Each of the fins 420 is an actuatable, electrically conductive fin coupled to the distal portion of ground ring 250 such that the fin and the distal portion of ground ring 250 are electrically continuous. Each fin 420 is positioned such that when actuated, a distal portion of the fin is extended in a direction away from the bit body of pulsed-power drill bit 114 proximate to the distal portion of ground ring 250 creating an effective outer diameter of ground ring 250 that is greater than the outer diameter of ground ring 250 itself. In one example, the outer diameter of ground ring 250 may be on the order of 8 inches, and the effective outer diameter of ground ring 250 following actuation of one or more fins 420 may be on the order of 8.5 inches. Other ground ring diameters and effective ground ring diameters are possible. In some cases, actuating one or more of the fins 420 increases an effective surface area of the distal portion of ground ring 250 that comes into contact with the rock formation on the sidewall surfaces of the wellbore during PD operations. For example, any fins 420 that have been actuated to extend beyond the outer diameter of the ground ring 250 provide respective contact points on the rock formation that cause a larger diameter hole to be drilled in the rock formation as the pulsed-power drill bit 114 rotates. When the pulsed-power drill bit 114 is operating with one or more of the fins 420 extended, the effective outer diameter of the ground ring 250 may subsequently be decreased by retracting one or more of the extended fins 420.

As shown, ground ring 250 includes multiple openings, or fluid flow ports, 260 through which drilling fluid flows to remove fractured rock from a wellbore during PD operations and each of the actuatable, electrically conductive fins 420 is positioned such that it does not impede fluid flow through the openings 260. For example, a given fin 420 may be positioned in a track, channel, or slot between two of the openings 260 through which the given fin 420 travels when actuated.

Actuator 410 may be or include a mechanical, hydraulic, pneumatic or electrical actuator configured to cause one or more of the fins 420 to be extended or retracted when actuated. The fins 420 may be extended or retracted by push or pull rods, hydraulics, pneumatics, or other linkage mechanisms, with or without biasing (e.g., springs), that are coupled to an actuation mechanism, such as those described herein. In one example, actuator 410 may be or include a mandrel that, when actuated, moves in a downhole direction, applying a force on each of the actuatable, electrically conductive fins 420 to guide the fin into an extended position. The actuator or mandrel 410 might or might not be perfectly axial to the bit. To achieve variable actuation across the fins, the actuator or mandrel 410 may be tilted off axis to actuate only a few fins at a time as the bit rotates. In the illustrated example, the actuator or mandrel 410 may be actuated using pneumatics, hydraulics, electronics, or any other energy source. In other examples, the fins 420 may be actuated using pneumatics, hydraulics, electronics, or any other energy source via a solenoid or controller rather than a mandrel.

Any suitable number of actuatable, electrically conductive fins may be coupled to a variable diameter ground ring. The actuatable, electrically conductive fins may be located in different positions or orientations with respect to the ground ring of a pulsed-power drill bit than the positions and orientations shown in FIG. 4. The actuatable, electrically conductive fins may be distributed symmetrically or asymmetrically in respective positions around the perimeter of the ground ring of a pulsed-power drill bit. One of the actuatable, electrically conductive fins may overlap at least a portion of another one of the actuatable, electrically conductive fins when both fins are actuated. In one example, multiple ones of the actuatable, electrically conductive fins may overlap respective neighboring fins when actuated, collectively creating a complete gauge radius or forming a plate over at least a portion of the ground ring of a pulsed-power drill bit rather than an intermittent radius as shown in the example illustrated in FIG. 4. Actuatable, electrically conductive fins that overlap other actuatable, electrically conductive fins may include openings through which drilling fluid flows during PD operations. The openings in the actuatable, electrically conductive fins may be aligned with respective openings, or fluid ports, on the ground ring of a pulsed-power drill bit when the actuatable, electrically conductive fins are actuated. In one example, two or more of the actuatable, electrically conductive fins may be coupled to the distal portion of the ground ring of a pulsed-power drill bit at a same distance from the distal end of the drill bit.

In one example, each of the actuatable, electrically conductive fins may be individually controllable to actuate the fin. In one example, at least a subset of the actuatable, electrically conductive fins are collectively controllable to be actuated at substantially the same time and/or to be retracted at substantially the same time. In one example, the pulsed-power drill bit may include a spring element positioned to hold one or more actuatable, electrically conductive fins in a retracted position when the actuatable, electrically conductive fins are not actuated.

When actuated, the distal portion of an actuatable, electrically conductive fin may be extended in a direction away from the bit body or in a direction toward the bit body such that the actuatable, electrically conductive fin is repositioned in a selected one of multiple potential extended or retracted positions. In one example, the actuatable, electrically conductive fin may be incrementally extended or retracted by successive actuations. In one example, a single actuation may reposition the actuatable, electrically conductive fin in a particular extended or retracted position that is selected dependent on a control signal received from a PDC. In one example, when actuated, the distal portion of an actuatable, electrically conductive fin may be extended in a direction away from the bit body until it comes in contact with a sidewall surface of the wellbore, at which point the actuation automatically stops. The actuation may be performed in a single, smooth motion or as a series of individual, incremental motions. In one example, a sensor on the pulsed-power drill bit may detect the point at which the actuatable, electrically conductive fin comes in contact with the sidewall surface of the wellbore and may provide a response record or measurement indicating the contact to an SAS and/or PDC to effect the cessation of the actuation. In one example, a sensor on the pulsed-power drill bit may detect the point at which the extension of one or more actuatable, electrically conductive fin causes the annular clearance, or the average annular clearance, between the wellbore and the BHA to which the pulsed-power drill bit is attached to drop below a predetermined maximum annular clearance and may provide a response record or measurement indicating this condition to an SAS and/or PDC to effect the cessation of the actuation.

Subsequent to extending one or more actuatable, electrically conductive fins, the PDC may disable the actuation control signals previously used to extend the fins to cause a retraction of any extended fins or may output one or more retraction control signals to explicitly cause a retraction of any extended fins. In one example, if the actuatable, electrically conductive fins are spring-loaded, disabling the actuation control signals previously used to extend the fins may allow the fins to return to their retracted state without receiving an explicit retraction control signal.

Figure 5:
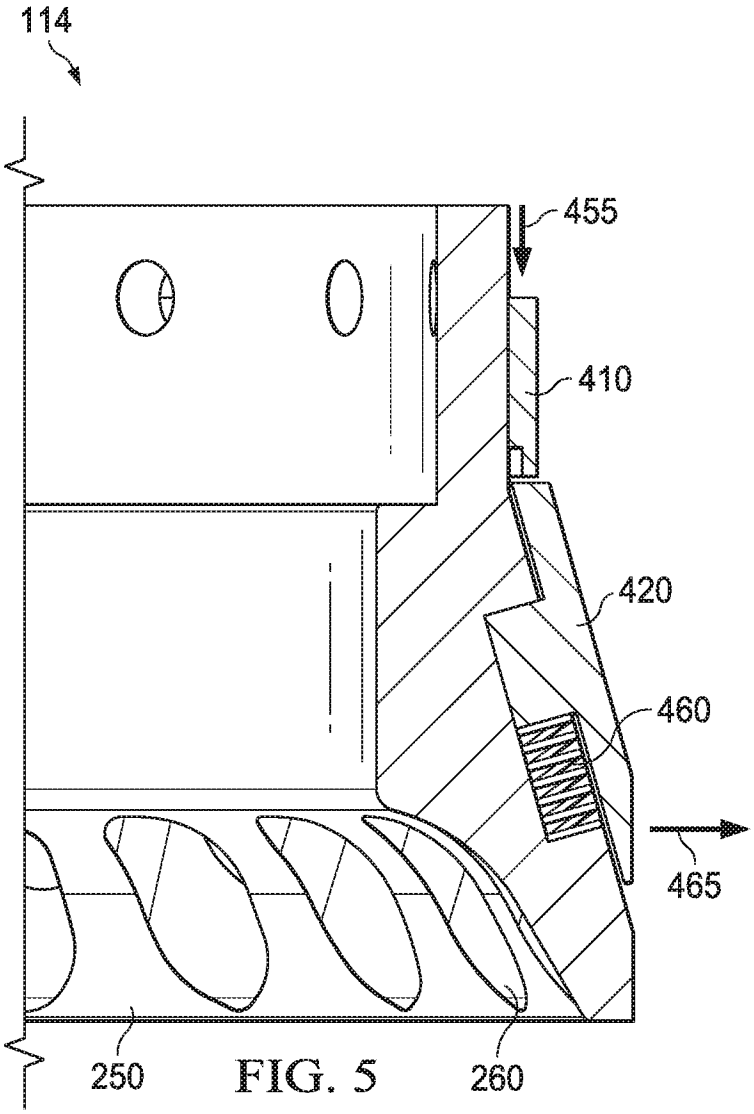
FIG. 5 is a perspective view of components of an example pulsed-power drill bit including a variable diameter ground ring and a spring-loaded fin.

FIG. 5 is a perspective view of components of an example pulsed-power drill bit including a variable diameter ground ring and a spring-loaded fin. Components of the example pulsed-power drill bit illustrated in FIG. 5 may be similar to components of the example pulsed-power drill bit illustrated in FIG. 4. In the illustrated example, pulsed-power drill bit 114 includes a variable diameter ground ring 250, a spring-loaded, actuatable, electrically conductive fin 420, an actuator 410 and a spring 460. As in the example illustrated in FIG. 4, ground ring 250 may be coupled to a bit body of pulsed-power drill bit 114 proximate to an electrode (not shown in FIG. 5) and have a distal portion for engaging with a sidewall surface of a wellbore. The electrode and ground ring 250 may be positioned in relation to each other such that an electric field produced by a voltage applied between ground ring 250 and the electrode is enhanced at a portion of the electrode proximate to the distal portion of the electrode and at a portion of ground ring 250 proximate to the distal portion of the ground ring 250. The fin 420 is a spring-loaded, actuatable, electrically conductive fin coupled to the distal portion of ground ring 250 such that the fin and the distal portion of ground ring 250 are electrically continuous. The fin 420 is positioned such that when actuated, a distal portion of the fin is extended in a direction away from the bit body of pulsed-power drill bit 114 proximate to the distal portion of ground ring 250 creating an effective outer diameter of ground ring 250 that is greater than the outer diameter of ground ring 250 itself. In some cases, actuating fin 420 increases an effective surface area of the distal portion of ground ring 250 that comes into contact with the rock formation on the sidewall surfaces of the wellbore during PD operations. For example, if fin 420 has been actuated to extend beyond the outer diameter of the ground ring 250, it provides a contact point on the rock formation that causes a larger diameter hole to be drilled in the rock formation as the pulsed-power drill bit 114 rotates. When the pulsed-power drill bit 114 is operating with one or more of the fins 420 extended, the effective outer diameter of the ground ring 250 may subsequently be decreased by retracting one or more of the extended fins 420.

As shown, ground ring 250 includes multiple openings, or fluid flow ports, 260 through which drilling fluid flows to remove fractured rock from a wellbore during PD operations and the spring-loaded, actuatable, electrically conductive fin 420 is positioned such that it does not impede fluid flow through the openings 260. For example, fin 420 may be positioned in a track, channel, or slot between two of the openings 260 through which fin 420 travels when actuated. In another example, hydraulic pressure may be used to bias the fin to an under gauge position when at rest.

Actuator 410 may be or include a mechanical, hydraulic, pneumatic, or electrical actuator configured to cause fin 420 to be extended when actuated. Fin 420 may be extended by push or pull rods, hydraulics, pneumatics, or other linkage mechanisms that are coupled to an actuation mechanism, such as those described herein. Actuator 410 may include a telescoping feature utilizing a spring-loaded mandrel within a housing that, when actuated, moves in a downhole direction, applying a force on the actuatable, electrically conductive fin 420 to guide the fin into an extended position.

In the illustrated example, fin 420 is spring-loaded such that, until actuator 410 is enabled, fin 420 is held in a retracted position by spring 460. When actuator 410 is enabled, actuator 410 applying a force on fin 420 in a direction of energy input and movement 455 that causes the distal end of fin 420 to be extended, moving in a direction 465 away from the bit body of pulsed-power drill bit 114 to increase the effective outer diameter of ground ring 250. In this example, disabling the actuation control signals previously used to extend the fins 420 may allow the fins 420 to return to their retracted state without receiving an explicit retraction control signal.

Figure 6A:
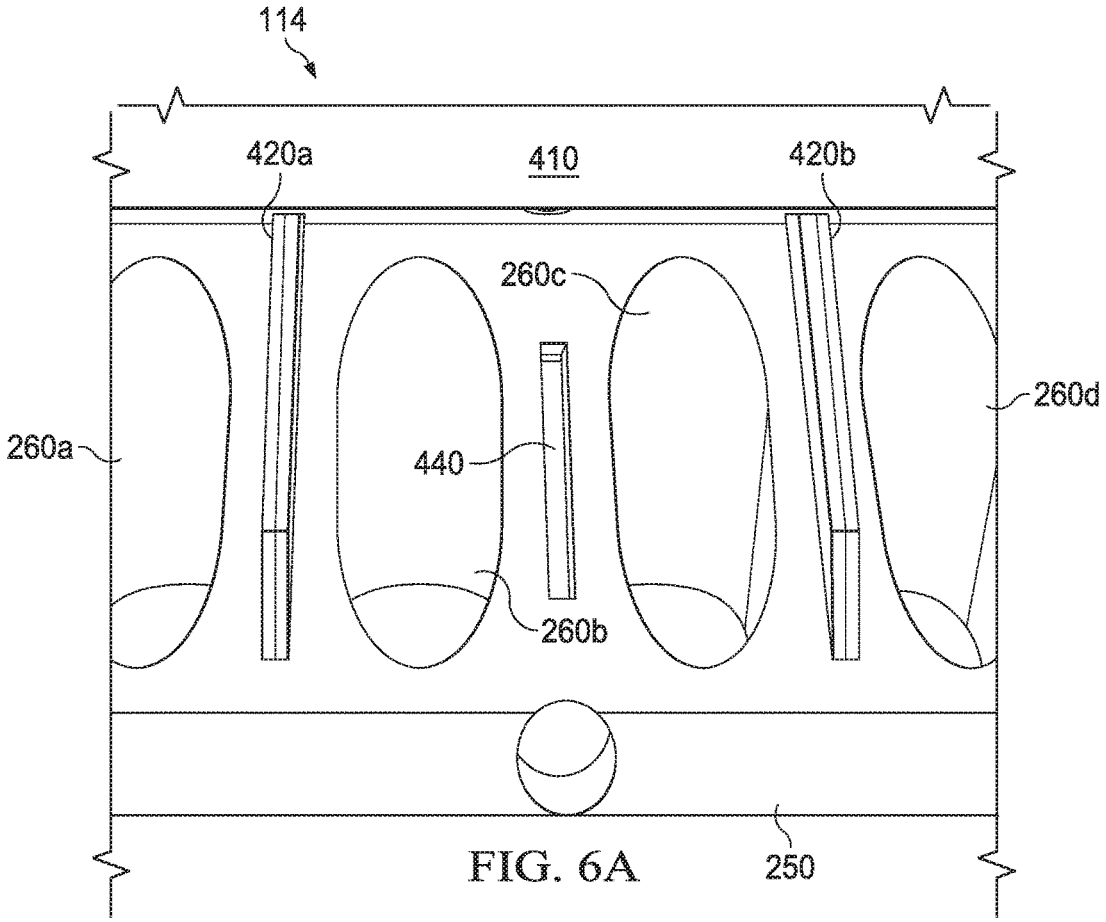
FIG. 6A is a perspective view of components of an example pulsed-power drill bit in which actuatable, electrically conductive fins are shown within respective slots of a variable diameter ground ring.

FIG. 6A is a perspective view of components of an example pulsed-power drill bit in which actuatable, electrically conductive fins are shown within respective slots of a variable diameter ground ring. Components of the example pulsed-power drill bit illustrated in FIG. 6A may be similar to components of the example pulsed-power drill bit illustrated in FIG. 4. For example, pulsed-power drill bit 114 includes a variable diameter ground ring 250, multiple actuatable, electrically conductive fins 420, and an actuator 410. Ground ring 250 may be coupled to a bit body of pulsed-power drill bit 114 proximate to an electrode (not shown in FIG. 6A) and have a distal portion for engaging with a sidewall surface of a wellbore. The electrode and ground ring 250 may be positioned in relation to each other such that an electric field produced by a voltage applied between ground ring 250 and the electrode is enhanced at a portion of the electrode proximate to the distal portion of the electrode and at a portion of ground ring 250 proximate to the distal portion of the ground ring 250. Each of the fins 420 is an actuatable, electrically conductive fin coupled to the distal portion of ground ring 250 such that the fin and the distal portion of ground ring 250 are electrically continuous. Each fin 420 is positioned such that when actuated, a distal portion of the fin is extended in a direction away from the bit body of pulsed-power drill bit 114 proximate to the distal portion of ground ring 250 creating an effective outer diameter of ground ring 250 that is greater than the outer diameter of ground ring 250 itself. In some cases, actuating one or more of the fins 420 increases an effective surface area of the distal portion of ground ring 250 that comes into contact with the rock formation on the sidewall surfaces of the wellbore during PD operations. For example, any fins 420 that have been actuated to extend beyond the outer diameter of the ground ring 250 provide respective contact points on the rock formation that cause a larger diameter hole to be drilled in the rock formation as the pulsed-power drill bit 114 rotates. When the pulsed-power drill bit 114 is operating with one or more of the fins 420 extended, the effective outer diameter of the ground ring 250 may subsequently be decreased by retracting one or more of the extended fins 420.

As shown, ground ring 250 includes multiple openings, or fluid flow ports, 260 through which drilling fluid flows to remove fractured rock from a wellbore during PD operations and each of the actuatable, electrically conductive fins 420 is positioned such that it does not impede fluid flow through the openings 260. In the illustrated example, each fin 420 may be positioned in a slot between two of the openings 260 through which the given fin 420 travels when actuated, such as a respective slot 440 (not visible beneath fins 420*a* and 420*b*).

Actuator 410 may be or include a mechanical, hydraulic, pneumatic, or electrical actuator configured to cause one or more of the fins 420 to be extended when actuated. The fins 420 may be extended or retracted by push or pull rods, hydraulics, pneumatics, or other linkage mechanisms, with or without biasing (e.g., springs), that are coupled to an actuation mechanism, such as those described herein. In one example, actuator 410 may be or include a mandrel that, when actuated, moves in a downhole direction, applying a force on each of the actuatable, electrically conductive fins 420 to guide the fin into an extended position.

Figure 6B:
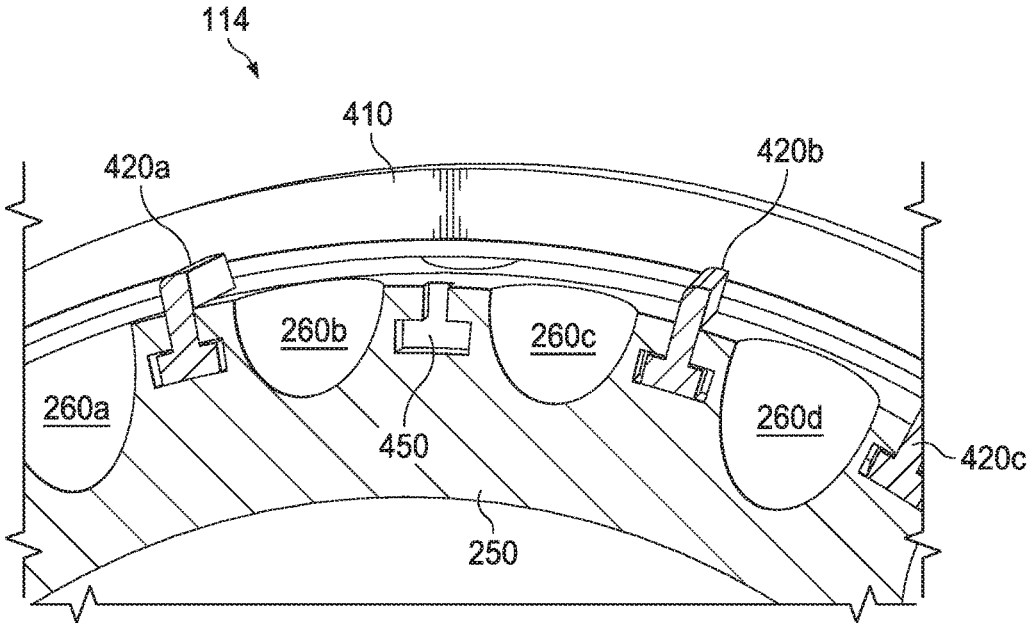
FIG. 6B is a perspective view of components of an example pulsed-power drill bit in which actuatable, electrically conductive fins are shown within respective T-channels of a variable diameter ground ring.

FIG. 6B is a perspective view of components of an example pulsed-power drill bit in which actuatable, electrically conductive fins are shown within respective T-channels of a variable diameter ground ring. Components of the example pulsed-power drill bit illustrated in FIG. 6A may be similar to components of the example pulsed-power drill bit illustrated in FIG. 4, although fins 420 illustrated in FIG. 6B may be shaped differently than fins 420 illustrated in FIG. 4. For example, pulsed-power drill bit 114 includes a variable diameter ground ring 250, multiple actuatable, electrically conductive fins 420, and an actuator 410. Ground ring 250 may be coupled to a bit body of pulsed-power drill bit 114 proximate to an electrode (not shown in FIG. 6B) and have a distal portion for engaging with a sidewall surface of a wellbore. The electrode and ground ring 250 may be positioned in relation to each other such that an electric field produced by a voltage applied between ground ring 250 and the electrode is enhanced at a portion of the electrode proximate to the distal portion of the electrode and at a portion of ground ring 250 proximate to the distal portion of the ground ring 250. Each of the fins 420 is an actuatable, electrically conductive fin coupled to the distal portion of ground ring 250 such that the fin and the distal portion of ground ring 250 are electrically continuous. Each fin 420 is positioned such that when actuated, a distal portion of the fin is extended in a direction away from the bit body of pulsed-power drill bit 114 proximate to the distal portion of ground ring 250 creating an effective outer diameter of ground ring 250 that is greater than the outer diameter of ground ring 250 itself. In some cases, actuating one or more of the fins 420 increases an effective surface area of the distal portion of ground ring 250 that comes into contact with the rock formation on the sidewall surfaces of the wellbore during PD operations. For example, any fins 420 that have been actuated to extend beyond the outer diameter of the ground ring 250 provide respective contact points on the rock formation that cause a larger diameter hole to be drilled in the rock formation as the pulsed-power drill bit 114 rotates. When the pulsed-power drill bit 114 is operating with one or more of the fins 420 extended, the effective outer diameter of the ground ring 250 may subsequently be decreased by retracting one or more of the extended fins 420.

As shown, ground ring 250 includes multiple openings, or fluid flow ports, 260 through which drilling fluid flows to remove fractured rock from a wellbore during PD operations and each of the actuatable, electrically conductive fins 420 is positioned such that it does not impede fluid flow through the openings 260. In the illustrated example, each fin 420 may be positioned in a channel between two of the openings 260 through which the given fin 420 travels when actuated, such as a respective T-channel 450 (not visible beneath fins 420*a*, 420*b*, and 420*c*). In one example, each fin 420 may be positioned in an L-shaped channel or in a channel having another geometry other than a "T" shape. In another example, magnetics may be used to hold the fins 420 in place rather than a mechanical retention channel lock.

Actuator 410 may be or include a mechanical, hydraulic, pneumatic, or electrical actuator configured to cause one or more of the fins 420 to be extended when actuated. The fins 420 may be extended or retracted by push or pull rods, hydraulics, pneumatics, or other linkage mechanisms, with or without biasing (e.g., springs), that are coupled to an actuation mechanism, such as those described herein. In one example, actuator 410 may be or include a mandrel that, when actuated, moves in a downhole direction, applying a force on each of the actuatable, electrically conductive fins 420 to guide the fin into an extended position.

Figure 7:
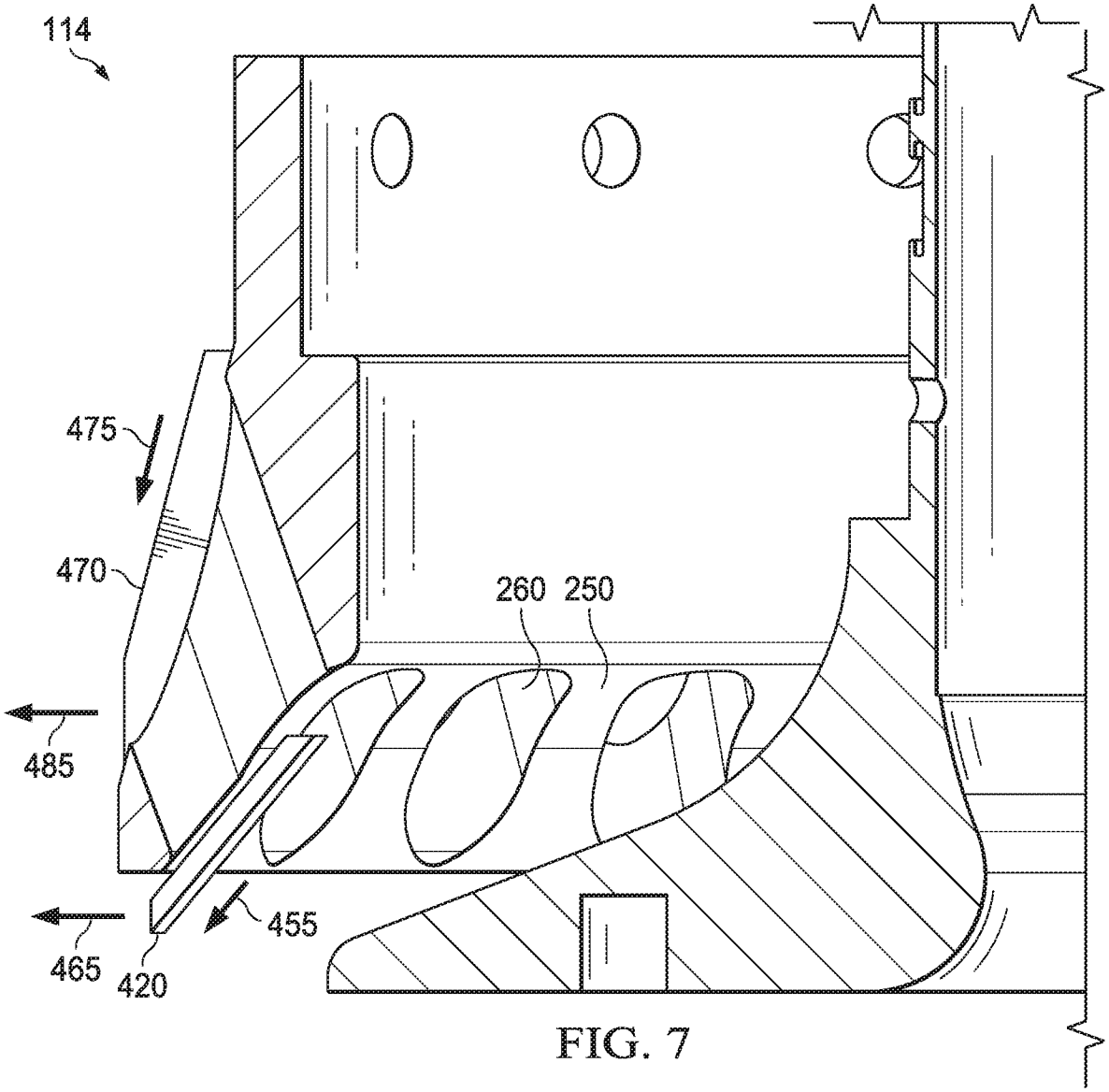
FIG. 7 is a perspective view illustrating two example locations for an actuatable, electrically conductive fin with respect to a variable diameter ground ring.

FIG. 7 is a perspective view illustrating two example locations for an actuatable, electrically conductive fin with respect to a variable diameter ground ring. In the illustrated example, pulsed-power drill bit 114 includes a variable diameter ground ring 250, an actuatable, electrically conductive fin 420, and an actuatable, electrically conductive fin 470. Ground ring 250 may be coupled to a bit body of pulsed-power drill bit 114 proximate to an electrode (not shown in FIG. 7) and have a distal portion for engaging with a sidewall surface of a wellbore. The electrode and ground ring 250 may be positioned in relation to each other such that an electric field produced by a voltage applied between ground ring 250 and the electrode is enhanced at a portion of the electrode proximate to the distal portion of the electrode and at a portion of ground ring 250 proximate to the distal portion of the ground ring 250. Each of the fins 420 and 470 is an actuatable, electrically conductive fin coupled to the distal portion of ground ring 250 such that the fin and the distal portion of ground ring 250 are electrically continuous. Each of the fins 420 and 470 is positioned such that when actuated, a distal portion of the fin is extended in a direction away from the bit body of pulsed-power drill bit 114 proximate to the distal portion of ground ring 250 creating an effective outer diameter of ground ring 250 that is greater than the outer diameter of ground ring 250 itself. Although one fin 420 and one fin 470 are illustrated in FIG. 7, a variable diameter ground ring 250 may include, or be coupled to, multiple fins 420 and/or multiple fins 470. Alternatively, a variable diameter ground ring 250 may include only one or more fins 420 or only one or more fins 470. In some cases, actuating one or more of the fins 420 and/or fins 470 increases an effective surface area of the distal portion of ground ring 250 that comes into contact with the rock formation on the sidewall surfaces of the wellbore during PD operations. For example, any fins 420 and/or fins 470 that have been actuated to extend beyond the outer diameter of the ground ring 250 provide respective contact points on the rock formation that cause a larger diameter hole to be drilled in the rock formation as the pulsed-power drill bit 114 rotates. When the pulsed-power drill bit 114 is operating with one or more of the fins 420 or 470 extended, the effective outer diameter of the ground ring 250 may subsequently be decreased by retracting one or more of the extended fins 420 or 470.

As shown, ground ring 250 includes multiple openings, or fluid flow ports, 260 through which drilling fluid flows to remove fractured rock from a wellbore during PD operations. and each of the actuatable, electrically conductive fins 420 and 470 is positioned such that it does not impede fluid flow through the openings 260. For example, fin 420 is positioned in a track, channel, or slot between two of the openings 260 through which the fin 420 travels when actuated. Fin 470 is positioned on, and coupled to, the outer diameter of the ground ring 250, such as in a track, channel, or slot.

Pulsed-power drill bit 114 may include a mechanical, hydraulic, pneumatic, or electrical actuator (not shown in FIG. 7) configured to cause one or more of the fins 420 and/or 470 to be extended when actuated. The fins 420 and/or 470 may be extended or retracted by push or pull rods, hydraulics, pneumatics, or other linkage mechanisms, with or without biasing (e.g., springs), that are coupled to an actuation mechanism, such as those described herein. In one example, an actuator may be or include a mandrel that, when actuated, moves in a downhole direction, applying a force on each of the actuatable, electrically conductive fins 420 and/or 470 to guide the fin or fins into an extended position. Fin 420 and/or fin 470 may be spring-loaded such that, until a corresponding actuator is enabled, each of the fins may be held in a retracted position by a respective spring (not shown in FIG. 7).

In one example, when an actuator is enabled, the actuator may apply a force on fin 420 in a direction of energy input and movement 455 that causes the distal end of fin 420 to be extended, moving in a direction 465 away from the bit body of pulsed-power drill bit 114 to increase the effective outer diameter of ground ring 250. In one example, when an actuator is enabled, the actuator may apply a force on fin 470 in a direction of energy input and movement 475 that causes the distal end of fin 470 to be extended, moving in a direction 485 away from the bit body of pulsed-power drill bit 114 to increase the effective outer diameter of ground ring 250.

Variable diameter ground ring 250 may include multiple actuatable, electrically conductive fins 420 (not shown in FIG. 7), each positioned in a manner similar to the position of fin 420 illustrated in FIG. 7. In one example, a PDC may determine that one or more fins 420 should be actuated to increase the effective outer diameter of ground ring 250 and may initiate actuation of the targets fins 420. In one example, a PDC may determine that all of the fins 420 should be actuated to increase the effective outer diameter of ground ring 250 and may initiate actuation of all of the fins 420. For example, the PDC may determine that all of the fins 420 should be actuated and that none of the fins 470 should be actuated to increase the effective outer diameter of ground ring 250.

Variable diameter ground ring 250 may include multiple actuatable, electrically conductive fins 470 (not shown in FIG. 7), each positioned in a manner similar to the position of fin 470 illustrated in FIG. 7. In one example, multiple actuatable, electrically conductive fins 470 may overlap respective neighboring fins when actuated, collectively forming a plate over at least a portion of the ground ring of a pulsed-power drill bit. Actuatable, electrically conductive fins that overlap other actuatable, electrically conductive fins may include openings through which drilling fluid flows during PD operations. The openings in the actuatable, electrically conductive fins may be aligned with respective openings 260 on ground ring 250 when the actuatable, electrically conductive fins 470 are actuated. In one example, a PDC may determine that one or more fins 470 should be actuated to increase or decrease the effective outer diameter of ground ring 250 and may initiate actuation of the targets fins 470 in a direction to effect the desired change. In one example, a PDC may determine that all of the fins 470 should be actuated to increase the effective outer diameter of ground ring 250 and may initiate actuation of all of the fins 470. For example, the PDC may determine that all of the fins 470 should be actuated and that none of the fins 420 should be actuated to increase the effective outer diameter of ground ring 250.

In one example, rather than selecting either fins 420 or fins 470, exclusively, a PDC may determine that one or more fins 420 and one or more fins 470 should be actuated to increase or decrease the effective outer diameter of ground ring 250.

As described in detail herein, a pulsed-power drilling system that includes a variable diameter ground ring may include a drill string, a power source, and a pulsed-power drill bit coupled to the drill string and the power source. The drill bit may include a bit body, an electrode coupled to a power source and the bit body, a ground ring coupled to the bit body proximate to the electrode, and an actuatable, electrically conductive fin coupled to the distal portion of the ground ring such that the fin and the distal portion of the ground ring are electrically continuous. The ground ring may have a distal portion for engaging with the sidewall surfaces of a wellbore. The electrode and the ground ring may be positioned in relation to each other such that an electric field produced by a voltage applied between the ground ring and the electrode is enhanced at a portion of the electrode proximate to the distal portion of the electrode and at a portion of the ground ring proximate to the distal portion of the ground ring. The actuatable, electrically conductive fin may be positioned such that when actuated, a distal portion of the fin is extended in a direction away from the bit body proximate to the distal portion of the ground ring creating an effective outer diameter of the ground ring that is greater than the outer diameter of the ground ring and, in some cases, increasing an effective surface area of the distal portion of the ground ring that comes into contact with the rock formation on the sidewall surfaces of the wellbore. When the pulsed-power drill bit is operating with one or more actuatable, electrically conductive fins extended, the effective outer diameter of the ground ring may subsequently be decreased by retracting one or more of the actuatable, electrically conductive fins that were previously extended.

Figure 8:
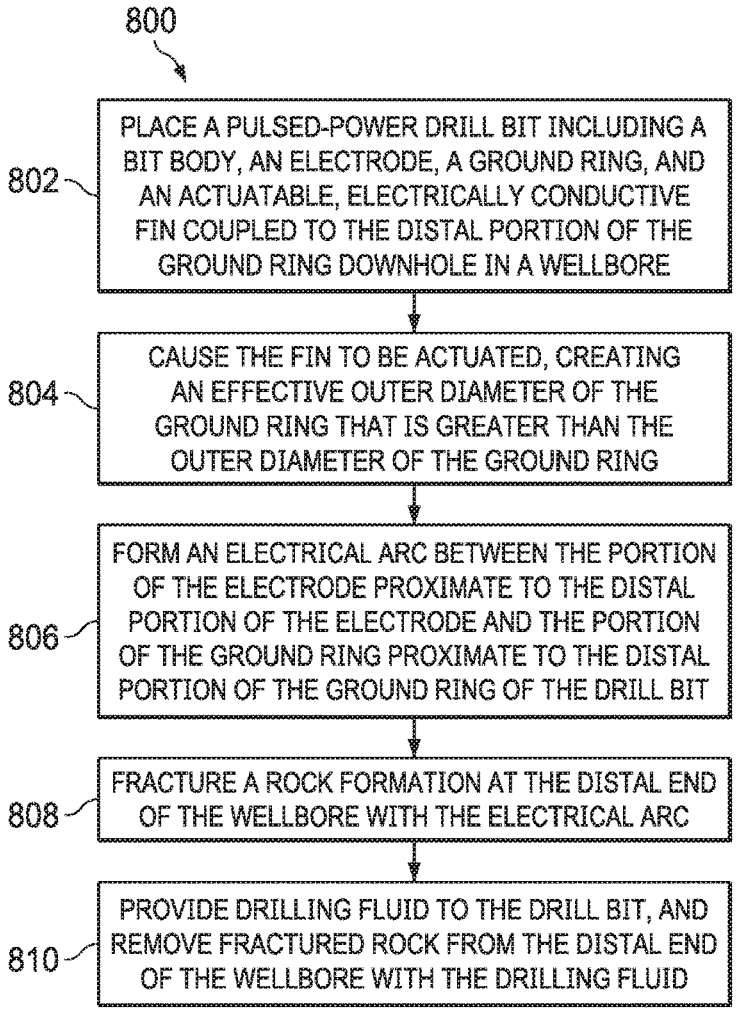
FIG. 8 is a flow chart illustrating an example method for performing a pulsed drilling (PD) operation.

The pulsed-power drilling system may also include a controller and a mechanical, hydraulic, pneumatic, or electrical actuator coupled to the fin and to the controller. The actuator may be configured to receive a control signal from the controller initiating actuation of the fin and, in response to receiving the control signal, to move the fin in a direction such that the distal portion of the fin is extended away from the bit body proximate to the distal portion of the ground ring FIG. 8 is a flow chart illustrating an example method for performing a PD operation using a pulsed-power drill bit placed downhole in a wellbore. For example, drill bit 114 illustrated in FIGS. 1 and 2 may be placed downhole in wellbore 116 as shown in FIG. 1. Some or all of the operations of method 800 may be performed, or initiated, by a PDC, such as PDC 155 illustrated in FIG. 1 or PDC 900 illustrated in FIG. 9. Method 800 includes, at 802, placing a pulsed-power drill bit including a bit body, an electrode, a ground ring, and an actuatable, electrically conductive fin coupled to the distal portion of the ground ring downhole in a wellbore. The ground ring may be coupled to the bit body proximate to the electrode and have a distal portion for engaging with the sidewall surfaces of the wellbore. The electrode and the ground ring may be positioned in relation to each other such that an electric field produced by a voltage applied between the ground ring and the electrode is enhanced at a portion of the electrode proximate to the distal portion of the electrode and at a portion of the ground ring proximate to the distal portion of the ground ring. The actuatable, electrically conductive fin may be coupled to the distal portion of the ground ring such that the fin and the distal portion of the ground ring are electrically continuous. The fin may be positioned such that when actuated, a distal portion of the fin is extended in a direction away from the bit body proximate to the distal portion of the ground ring. The ground ring may include a plurality of openings, or fluid flow ports, through which drilling fluid flows to remove fractured rock from the wellbore during PD operations and the fin may be positioned in a track, channel, or slot between two of the plurality of openings through which the fin travels when actuated such that it does not impede fluid flow through the openings.

At 804, method 800 includes causing the fin to be actuated, creating an effective outer diameter of the ground ring that is greater than the outer diameter of the ground ring itself. In some cases, actuating the fin may also increase the effective surface area of the distal portion of the ground ring that comes in contact with the rock formation on the sidewall surfaces of the wellbore. For example, any fins that have been actuated to extend beyond the outer diameter of the ground ring provide respective contact points on the rock formation that cause a larger diameter hole to be drilled in the rock formation as the pulsed-power drill bit 114 rotates. When the pulsed-power drill bit 114 is operating with one or more of the fins extended, the effective outer diameter of the ground ring may subsequently be decreased by retracting one or more of the extended fins (not shown in FIG. 8).

As described herein, the fin may be actuated in response to an analysis of data associated with the PD operation. For example, a PDC may receive measurements representing responses recorded by various acoustic, electrical or electromagnetic sensors including, but not limited to, received signals representing pulse drilling signals in the form of high-energy electrical pulses or acoustic and/or electromagnetic waves produced by the electrical arcs during a PD operation. This logging data may include data captured in real time during the PD operation and/or logging data previously obtained when drilling through a similar type of material. The PDC may receive data representing certain characteristics of cuttings including, but not limited to, data indicative of the minerology of the formation (e.g., whether it is shale or hard sandstone), data indicative of the size or coarseness of the cuttings, data indicative of the brittleness of the cuttings, data indicative of the confining stress field (e.g., whether it is a high, medium, or low confining stress) data indicative of the depth from which the cuttings were obtained and/or data indicative of the hydrostatic pressure (e.g., the floor pressure) at the location from which the cuttings were obtained. The PDC may also receive drilling performance measurement data, and/or other feedback returned from various downhole components of the PPD system. The received data may be analyzed to determine whether or when to actuate the fin.

Causing the fin to be actuated may include receiving a control signal initiating actuation of the fin and moving, by a mechanical, hydraulic, pneumatic, or electrical actuator and in response to receiving the control signal, the fin in a direction such that the distal portion of the fin is extended away from the bit body proximate to the distal portion of the ground ring. For example, a control signal may be generated by a PDC located at the surface or downhole in response to an analysis performed by a SAS and may be received from the PDC by a mechanical, hydraulic, pneumatic, or electrical actuator downhole to initiate the actuation of the fin. The fin may be actuated while the drill bit remains downhole in the wellbore.

At 806, the method includes forming an electrical arc between the portion of the electrode proximate to the distal portion of the electrode and the portion of the ground ring proximate to the distal portion of the ground ring of the drill bit. For example, electrical power may be provided to a PG circuit coupled to the drill bit. The PG circuit may be coupled to a first electrode and a second electrode of the drill bit. The first electrode may be electrode 212 and the second electrode may be ground ring 250 discussed above with respect to FIG. 2. The PG circuit may be implemented within pulsed-power tool 230 shown in FIG. 2 and may receive electrical power from a power source on the surface, from a power source located downhole, or from a combination of a power source on the surface and a power source located downhole. Electrical power may be supplied downhole to a PG circuit by way of a cable, such as cable 220 described above with respect to FIG. 2. The power may be provided to the PG circuit within pulse-power tool 230 at a power source input. High-energy electrical pulses, sometimes referred to as pulse drilling signals, may be generated by the PG circuit for the drill bit by converting the electrical power received from the power source into high-energy electrical pulses. In one example, the PG circuit may use electrical resonance to convert a low-voltage power source (for example, approximately 1 kV to approximately 5 kV) into high-energy electrical pulses capable of applying at least 60 kV across electrodes of the drill bit. The PG circuit may charge a capacitor between electrodes of the drill bit, causing an electrical arc. As the voltage across the capacitor increases, the voltage across the first electrode and the second electrode increases. As described above with reference to FIGS. 1 and 2, when the voltage across the electrodes becomes sufficiently large, an electrical arc may form through the drilling fluid and/or a rock formation that is proximate to the electrodes. The arc may provide a temporary electrical short between the electrodes, and thus may discharge, at a high current level, the voltage built up across the output capacitor. A switch located downhole within the PG circuit may close to discharge a capacitor through a transformer to charge an output capacitor that is electrically coupled between the first electrode and the second electrode. The switch may close to generate a high-energy electrical pulse and may be open between pulses.

At 808, method 800 includes fracturing a rock formation at the distal end of the wellbore with the electrical arc. For example, as described above with reference to FIGS. 1 and 2, the electrical arc greatly increases the temperature and the pressure of the portion of the rock formation in the immediate vicinity of the electrical arc, such that the rock formation at the distal end of the wellbore may be fractured with the electrical arc. The temperature may be sufficiently high to vaporize any water or other fluids that may be touching or near the arc and may also vaporize part of the rock. The vaporization process creates a high-pressure plasma which expands and, in turn, fractures the surrounding rock.

At 810, the method includes providing drilling fluid to the drill bit and removing fractured rock from the distal end of the wellbore with the drilling fluid. For example, as described above with reference to FIG. 1, drilling fluid 122 may move the fractured rock away from the electrodes and uphole from the drill bit. As described above with respect to FIG. 2, drilling fluid 122 and the fractured rock may flow away from electrodes through fluid flow ports 260 on the ground ring of the drill bit.

Modifications, additions, or omissions may be made to method 800 without departing from the scope of the disclosure. For example, the order of the steps may be performed in a different manner than that described, and some steps may be performed at the same time. Additionally, each individual step may include additional steps without departing from the scope of the present disclosure. Method 800 may include additional operations not shown in FIG. 8. For example, the method may include, subsequent to causing the actuatable, electrically conductive fin to be actuated, causing the actuatable, electrically conductive fin to be retracted. Causing the actuatable, electrically conductive fin to be retracted may include the PDC disabling an actuation control signal or outputting an additional control signal to cause a retraction of the actuatable, electrically conductive fin. In one example, if the actuatable, electrically conductive fin is spring-loaded, disabling an actuation control signal may allow the actuatable, electrically conductive fin to return to its retracted state without receiving an explicit retraction control signal. The operations of method 800 may be repeated, as needed, to perform a PD operation. For example, at least some operations of method 800 may be performed serially or in parallel to actuate two or more actuatable, electrically conductive fins during a PD operation.

FIG. 9 is a block diagram illustrating an example PDC. In this example, the functionality of PDC 155 and SAS 150 illustrated in FIG. 1 may be integrated within PDC 900, which acts as a master controller for PD operations. PDC 900 may be positioned at the surface for use with PPD system 100, or at any other suitable location. PDC 900 may be configured to determine formation characteristics by analyzing sensor responses recorded during a PD operation, characteristics of cuttings, and/or any other suitable inputs to such an analysis including, but not limited to, those described herein. PDC 900 may also be configured to determine the ROP, wellbore diameter or caliper, or other drilling performance measurements associated with a PD operation.

PDC 900 may be configured to determine whether or when to actuate one or more actuatable, electrically conductive fins to increase or decrease the effective outer diameter of the ground ring of a pulsed-power drill bit. In response to a determination that one or more fins should be actuated, PDC 900 may be configured to cause an actuation of one or more actuatable, electrically conductive fins while the drill bit remains downhole in the wellbore (e.g., without removing the drill bit from the wellbore) to extend or retract the fins in a direction to effect the desired change. In response to a determination that one or more fins that were previously extended should be retracted, PDC 900 may be configured to cause a retraction or to allow spring-loaded fins to be retracted by their respective springs.

In the illustrated example, PDC 900 includes processing unit 910 coupled to one or more input/output interfaces 920 and data storage 918 over an interconnect 916. Interconnect 916 may be implemented using any suitable computing system interconnect mechanism or protocol. Processing unit 910 may be configured to determine the ROP, wellbore diameter or caliper, or other drilling performance measurements associated with a PD operation based on feedback received from various downhole sensors or other downhole components, or other factors. Processing unit 910 may be configured to determine whether or when to actuate one or more actuatable, electrically conductive fins to increase or decrease the effective outer diameter of the ground ring based, at least in part, on inputs received by input/output interfaces 920, some of which may include measurements representing responses recorded by various sensors within the wellbore, such as wellbore 116 illustrated in FIG. 1. The measurements may include voltages, currents, ratios of voltages to current, electric field strengths or magnetic field strengths. For example, processing unit 910 may be configured to perform one or more inversions based on simulation models that relate the electromagnetic properties of the formation to electromagnetic data collected by downhole sensors and/or relate the acoustic properties of the formation to acoustic data collected by downhole sensors. PDC 900 may also be configured to initiate or cause actuation of the one or more actuatable, electrically conductive fins to increase or decrease the effective outer diameter of the ground ring in response to a determination to do so.

Processing unit 910 may include processor 912 that is any system, device, or apparatus configured to interpret and/or execute program instructions and/or process data associated with PDC 900. Processor 912 may be, without limitation, a microprocessor, microcontroller, digital signal processor (DSP), application specific integrated circuit (ASIC), or any other digital or analog circuitry configured to interpret and/or execute program instructions and/or process data. In some cases, processor 912 may interpret and/or execute program instructions and/or process data stored in one or more computer-readable media 914 included in processing unit 910 to perform any of the methods described herein.

Computer-readable media 914 may be communicatively coupled to processor 912 and may include any system, device, or apparatus configured to retain program instructions and/or data for a period of time (e.g., computer-readable media). Computer-readable media 914 may include random access memory (RAM), read-only memory (ROM), solid state memory, electrically erasable programmable read-only memory (EEPROM), disk-based memory, a PCMCIA card, flash memory, magnetic storage, opto-magnetic storage, or any suitable selection and/or array of volatile or non-volatile memory that retains data after power to processing unit 910 is turned off. For example, computer-readable media 914 may include instructions for determining one or more characteristics of formation 118 based on signals received from various acoustic, electrical or electromagnetic sensors by input/output interfaces 920, logging data, or characteristics of cuttings; for determining the ROP, wellbore diameter or caliper, or other drilling performance measurements associated with a PD operation; for determining whether or when to actuate one or more actuatable, electrically conductive fins to increase or decrease the effective outer diameter of the ground ring based on current or changing conditions or drilling performance measurements; and for initiating or causing actuation of one or more actuatable, electrically conductive fins to increase or decrease the effective outer diameter of the ground ring in response to a determination to do so.

Computer-readable media 914 may include instructions for implementing one or more control algorithms to analyze input signals received from other components of the PPD system, logging data, sensor responses, drilling performance measurements, and/or other inputs and to generate output signals that can be used as control signals to initiate appropriate actuation or retraction of various actuatable, electrically conductive fins. Computer-readable media 914 may include instructions for implementing different drilling modes, each of which defines a respective collection of operational goals and/or operating parameters of a PPD system in support of particular operational goals, and for determining whether and when to initiate actuation of one or more actuatable, electrically conductive fins in response to changing conditions and/or drilling performance measurements. For example, each drilling mode may define one or more of a respective effective outer diameter for a ground ring of a pulsed-power drill bit, a pulse generation mode, a drilling rate (e.g., a rate of penetration), an arc path of pulses between and amongst electrodes, a volumetric flow rate to be input to or bypassed from the drill bit via drill string valves, a drilling fluid velocity or directionality at the drill bit, a distribution of the flow of the drilling fluid at the drill bit, a rise time of an output pulse, a voltage or other electrical parameter associated with an output pulse, a pulse repetition rate, a wellbore diameter or caliper, a hole quality, a drilling process energy efficiency, a taxing of the tool componentry, or other parameter indicative of the operational goals for a PD operation and/or a desired characteristic of the cuttings, returned drilling fluid, and/or entrained gas.

Input/output interfaces 920 may be coupled to an optical fiber, such as an optical fiber element of telemetry mechanism 160 illustrated in FIG. 1, over which it may send and receive signals. Signals received by input/output interfaces 920 may include measurements representing responses recorded by various sensors at the surface or downhole during a PD operation or results of calculations made based on those responses. For example, signals received by input/output interfaces 920 may include measurements representing responses recorded by various acoustic, electrical or electromagnetic sensors. These measurements may include, without limitation, measurements of voltage, current, electric field strength, or magnetic field strength. These and other inputs may be received using communication interfaces or telemetry mechanisms other than an optical fiber including, but not limited to, the mechanisms for receiving acoustic, electric or electromagnetics signals described above, and various mechanical telemetry methods.

The control signals generated by PDC 900 may be communicated to one or more electrical or mechanical actuators 925 located downhole via input/output interfaces 920 using any suitable communication protocol interfaces or telemetry mechanisms. For example, a control signal may be sent electrically over a power cable (e.g., over surface cable 143 illustrated in FIG. 1 and a sub-surface cable, or over cable 220 illustrated in FIG. 2) or over a separate control cable, via an optical fiber, a wireline or a wired pipe, or via acoustic, mud pulse, electromagnetic or other telemetry mechanisms including, but not limited to, those described herein in reference to telemetry mechanism 160 illustrated in FIG. 1. In some cases, PDC 900 may communicate an electrical or mechanical control signal directly to a downhole actuator 925 to cause actuation of one or more targeted actuatable, electrically conductive fins. In other cases, when the control signal does not convey actuation energy, the control signal may be communicated to an intermediate downhole component that receives the control signal and translates it to initiate the actuation of the targeted fins. In one example, the intermediate downhole component may engage a power supply for the actuation, such as a battery, a generator power, or power received from the surface over a cable that is switched in, in a controlled manner, to a relay or solid state switch. Where a control signal output by PDC 900 for initiating the actuation of one or more targeted fins does not directly cause the desired actuation of the targeted fin or fins, an actuator may be used to translate the control signal to a second control signal that causes the actuation of the targeted fin or fins. For example, various mechanisms for converting electrical energy to mechanical force and displacement such as, for example, a solenoid, a hydraulic pump and associated control valves, or other actuator systems and associated linkages, may be used to translate a control signal generated at the surface to cause an actuation of one or more targeted fins.

In one example, PDC 900 may communicate a control signal to an actuator using mud pulse telemetry. In this example, a valve may be opened at the surface to create a pressure wave perturbation in the drilling fluid, or to vent or add pressure at the surface, which may be detected downhole. Measurements of the pressure taken downhole may be converted into amplitude-modulated or frequency-modulated patterns of mud pulses that carry information. For example, a particular pattern of mud pulses may indicate that one or more actuatable, electrically conductive fins should be actuated. Other suitable telemetry systems may include, but are not limited to, a weight-set method and a pressure set method. In some cases, a control signal communicated by PDC 900 may cause two or more separate components (e.g., capacitors, inductors, transformers, or resistors) of a single drive circuit to be toggled in or out, or may cause an adjusting mechanism (e.g., a solid state switch, a relay, or a purely mechanical switch) to disengage one circuit path conductor and/or engage another to actuate one or more targeted fins.

Data storage 918 may provide and/or store data and instructions used by processor 912 to perform any of the methods described herein for collecting and analyzing data from acoustic, electrical or electromagnetic sensors, logging data, or cuttings, for determining whether or when a fin should be actuated, and in which direction, and/or for causing an actuator 925 to effect such an actuation. In particular, data storage 918 may store data that may be loaded into computer-readable media 914 during operation of PDC 900. Data storage 918 may be implemented in any suitable manner, such as by functions, instructions, logic, or code, and may be stored in, for example, a relational database, file, application programming interface, library, shared library, record, data structure, service, software-as-service, or any other suitable mechanism. Data storage 918 may store and/or specify any suitable parameters that may be used to perform the described methods. For example, data storage 918 may store drilling mode definitions, logging data (including, but not limited to, measurements representing responses recorded by various acoustic, electrical or electromagnetic sensors during one or more PD operations), characteristics of analyzed cuttings, drilling performance measurement data, and/or feedback returned from various downhole components of the PPD system. Data storage 918 may provide information used to direct components of PDC 900 to analyze the data stored in data storage 918 to determine characteristics of a formation, such as formation 118 as shown in FIG. 1, to determine whether or when a fin should be actuated, and in which direction, and/or to cause an actuator to effect such an actuation. Information stored in data storage 918 may also include one or more models generated or accessed by processing unit 910. For example, data storage 918 may store a model used in an inversion process.

The elements shown in FIG. 9 are examples only and PDC 900 may include fewer or additional elements. Modifications, additions, or omissions may be made to PDC 900 without departing from the scope of the present disclosure. For example, PDC 900 illustrates one particular configuration of components, but any suitable configuration of components may be used. In one example, PDC 900 may include a Distributed acoustic sensing (DAS) subsystem. In this example, with an optical fiber positioned inside a portion of wellbore 116 (e.g., as an element of telemetry mechanism 160 illustrated in FIG. 1), the DAS subsystem may determine characteristics associated with formation 118 based on changes in strain caused by acoustic waves. The DAS subsystem may be configured to transmit optical pulses into the optical fiber, and to receive and analyze reflections of the optical pulse to detect changes in strain caused by acoustic waves.

Components of PDC 900 may be implemented either as physical or logical components. Furthermore, functionality associated with components of PDC 900 may be implemented with special and/or general purpose circuits or components. Components of PDC 900 may also be implemented by computer program instructions. Where a PDC and a SAS are implemented as two separate systems, each of these systems may include respective instances of the elements illustrated in FIG. 9. For example, each system may include a processing unit, a processor, computer-readable media storing respective computer program instructions to perform any of the methods described herein for the particular system, data storage, and one or more input/output interfaces for communicating with electrical or mechanical components, such as electrical or mechanical actuators.

While techniques for controlling the effective outer diameter of the ground ring of a pulsed-power drill bit during PD operations without removing the drill bit from the wellbore are described herein primarily in conjunction with a pulsed drilling controller, control of the actuation of the electrically conductive fins may be achieved using an analog mechanical approach. For example, a mechanical pressure sensor or a mechanical temperature sensor may be used to determine the correct pressure to actuate one or more of the fins.

While techniques for controlling the effective outer diameter of the ground ring of a pulsed-power drill bit during PD operations without removing the drill bit from the wellbore are described herein primarily in terms of their application in electrocrushing drilling, these techniques may also be used in systems that implement electrohydraulic drilling or that include a hybrid bit. For example, a hybrid bit may include an electrocrushing bit in an inner section and a drag bit in an outer section. The electrocrushing bit may be used to cut out the center of a wellbore, while the drag bit (which may be more efficient at high peripheral velocity than in a center position) may be used to cut out the formation around the outside of the center cut. In this example, at least some of the techniques for performing controlling the effective outer diameter of the ground ring of a pulsed-power drill bit described herein may be applied to the hybrid bit to optimize the drilling of the center of the wellbore using the electrocrushing bit in the inner section.

Embodiments herein may include:

A. A pulsed-power drill bit including a bit body, an electrode coupled to the bit body and having a distal portion, a ground ring coupled to the bit body proximate to the electrode and having a distal portion for engaging with a sidewall surface of a wellbore and defining an outer diameter of the ground ring, the electrode and the ground ring positioned in relation to each other such that an electric field produced by a voltage applied between the ground ring and the electrode is enhanced at a portion of the electrode proximate to the distal portion of the electrode and at a portion of the ground ring proximate to the distal portion of the ground ring, and an actuatable, electrically conductive fin coupled to the distal portion of the ground ring such that the fin and the distal portion of the ground ring are electrically continuous, the fin being positioned such that when actuated, a distal portion of the fin is extended in a direction away from the bit body proximate to the distal portion of the ground ring creating an effective outer diameter of the ground ring that is greater than the outer diameter of the ground ring.

B. A pulsed-power drilling system including a drill string and a pulsed-power drill bit coupled to the drill string, the drill bit including a bit body, an electrode coupled to the bit body and having a distal portion, a ground ring coupled to the bit body proximate to the electrode and having a distal portion for engaging with a sidewall surface of a wellbore and defining an outer diameter of the ground ring, the electrode and the ground ring positioned in relation to each other such that an electric field produced by a voltage applied between the ground ring and the electrode is enhanced at a portion of the electrode proximate to the distal portion of the electrode and at a portion of the ground ring proximate to the distal portion of the ground ring, and an actuatable, electrically conductive fin coupled to the distal portion of the ground ring such that the fin and the distal portion of the ground ring are electrically continuous, the fin being positioned such that when actuated, a distal portion of the fin is extended in a direction away from the bit body proximate to the distal portion of the ground ring creating an effective outer diameter of the ground ring that is greater than the outer diameter of the ground ring.

C. A method of drilling a wellbore including placing a pulsed-power drill bit downhole in a wellbore, the pulsed-power drill bit including a bit body, an electrode coupled to the bit body and having a distal portion, a ground ring coupled to the bit body proximate to the electrode and having a distal portion for engaging with a sidewall surface of the wellbore and defining an outer diameter of the ground ring, the electrode and the ground ring positioned in relation to each other such that an electric field produced by a voltage applied between the ground ring and the electrode is enhanced at a portion of the electrode proximate to the distal portion of the electrode and at a portion of the ground ring proximate to the distal portion of the ground ring, and an actuatable, electrically conductive fin coupled to the distal portion of the ground ring such that the fin and the distal portion of the ground ring are electrically continuous, the fin being positioned such that when actuated, a distal portion of the fin is extended in a direction away from the bit body proximate to the distal portion of the ground ring, creating an effective outer diameter of the ground ring that is greater than the outer diameter of the ground ring, and conducting pulsed-power drilling using the pulsed-power drill bit.

The pulsed-power drilling system of Embodiment B may include a pulsed-power drill bit of Embodiment A. The pulsed-power drill bit of Embodiment A and the pulsed-power drilling system of Embodiment B may be operated according to the method of drilling a wellbore of Embodiment C. Each of embodiments A, B and C may have one or more of the following additional elements in any combination unless clearly mutually exclusive:

Element 1: wherein the fin is one of a plurality of actuatable, electrically conductive fins, each of the plurality of fins being coupled to the distal portion of the ground ring such that the fin and the distal portion of the ground ring are electrically continuous. Element 2: wherein at least a subset of the plurality of fins are collectively controllable to actuate the at least a subset of the plurality of fins at substantially the same time. Element 3: wherein the fin overlaps at least a portion of another one of the plurality of fins. Element 4: wherein at least a subset of the plurality of fins are coupled to the distal portion of the ground ring at a same distance from the distal end of the drill bit. Element 5: wherein the pulsed-power drill bit includes a spring element positioned to hold the fin in a retracted position when the fin is not actuated. Element 6: wherein when actuated, the distal portion of the fin is extended in a direction away from the bit body such that the fin is repositioned in a selected one of a plurality of extended positions. Element 7: wherein when actuated, the distal portion of the fin is extended in a direction away from the bit body until it comes in contact with the sidewall surface of the wellbore. Element 8: wherein the ground ring includes a plurality of openings through which drilling fluid flows to remove fractured rock from the wellbore during pulsed drilling operations and the fin is positioned in a track, channel, or slot between two of the plurality of openings through which the fin travels when actuated. Element 9: wherein the pulsed-power drilling system includes a controller and a mechanical, hydraulic, pneumatic, or electrical actuator coupled to the fin and to the controller and configured to receive a control signal from the controller initiating actuation of the fin and, in response to receiving the control signal, to move the fin in a direction such that the distal portion of the fin is extended away from the bit body proximate to the distal portion of the ground ring. Element 10: wherein causing the fin to be actuated includes receiving a control signal initiating actuation of the fin and moving, by a mechanical, hydraulic, pneumatic, or electrical actuator and in response to receiving the control signal, the fin in a direction such that the distal portion of the fin is extended away from the bit body proximate to the distal portion of the ground ring. Element 11: wherein the method further includes providing drilling fluid to the drill bit and removing fractured rock from the end of the wellbore with the drilling fluid.

Although the present disclosure has been described with several embodiments, various changes and modifications may be suggested to one skilled in the art. It is intended that the present disclosure encompasses such various changes and modifications as falling within the scope of the appended claims.

What is claimed is:

1. A pulsed-power drill bit, comprising:

a bit body;

an electrode coupled to the bit body and having a distal portion;

a ground ring coupled to the bit body proximate to the electrode, the ground ring having a distal portion for engaging with a sidewall surface of a wellbore and defining an outer diameter of the ground ring and a plurality of openings through which drilling fluid flows to remove fractured rock from the wellbore during pulsed drilling operations, the electrode and the ground ring positioned in relation to each other such that an electric field produced by a voltage applied between the ground ring and the electrode is enhanced at a portion of the electrode proximate to the distal portion of the electrode and at a portion of the ground ring proximate to the distal portion of the ground ring; and an actuatable, electrically conductive fin coupled to the distal portion of the ground ring such that the fin and the distal portion of the ground ring are electrically continuous, the fin being positioned such that when actuated, a distal portion of the fin is extended in a direction away from the bit body proximate to the distal portion of the ground ring creating an effective outer diameter of the ground ring that is greater than the outer diameter of the ground ring, the fin further positioned in a track, channel, or slot between two of the plurality of openings through which the fin travels when actuated.

2. The pulsed-power drill bit of claim 1, wherein the fin is one of a plurality of actuatable, electrically conductive fins, each of the plurality of fins being coupled to the distal portion of the ground ring such that the fin and the distal portion of the ground ring are electrically continuous.

3. The pulsed-power drill bit of claim 2, wherein at least a subset of the plurality of fins are collectively controllable to actuate the at least a subset of the plurality of fins at substantially the same time.

4. The pulsed-power drill bit of claim 2, wherein the fin overlaps at least a portion of another one of the plurality of fins.

5. The pulsed-power drill bit of claim 2, wherein at least a subset of the plurality of fins are coupled to the distal portion of the ground ring at a same distance from the distal end of the drill bit.

6. The pulsed-power drill bit of claim 1, further comprising a spring element positioned to hold the fin in a retracted position when the fin is not actuated.

7. The pulsed-power drill bit of claim 1, wherein when actuated, the distal portion of the fin is extended in a direction away from the bit body such that the fin is repositioned in a selected one of a plurality of extended positions.

8. The pulsed-power drill bit of claim 1, wherein when actuated, the distal portion of the fin is extended in a direction away from the bit body until it comes in contact with the sidewall surface of the wellbore.

9. A pulsed-power drilling system, comprising:

a drill string; and a pulsed-power drill bit coupled to the drill string, the drill bit including:

a bit body;

an electrode coupled to the bit body and having a distal portion;

a ground ring coupled to the bit body proximate to the electrode, the ground ring having a distal portion for engaging with a sidewall surface of a wellbore and defining an outer diameter of the ground ring and a plurality of openings through which drilling fluid flows to remove fractured rock from the wellbore during pulsed drilling operations, the electrode and the ground ring positioned in relation to each other such that an electric field produced by a voltage applied between the ground ring and the electrode is enhanced at a portion of the electrode proximate to the distal portion of the electrode and at a portion of the ground ring proximate to the distal portion of the ground ring; and an actuatable, electrically conductive fin coupled to the distal portion of the ground ring such that the fin and the distal portion of the ground ring are electrically continuous, the fin being positioned such that when actuated, a distal portion of the fin is extended in a direction away from the bit body proximate to the distal portion of the ground ring creating an effective outer diameter of the ground ring that is greater than the outer diameter of the ground ring, the fin further positioned in a track, channel, or slot between two of the plurality of openings through which the fin travels when actuated.

10. The pulsed-power drilling system of claim 9, wherein the fin is one of a plurality of actuatable, electrically conductive fins, each of the plurality of fins being coupled to the distal portion of the ground ring such that the fin and the distal portion of the ground ring are electrically continuous.

11. The pulsed-power drilling system of claim 10, wherein at least a subset of the plurality of fins is collectively controllable to actuate the at least a subset of the plurality of fins at substantially the same time.

12. The pulsed-power drilling system of claim 10, wherein at least a subset of the plurality of fins are coupled to the distal portion of the ground ring at a same distance from the distal end of the drill bit.

13. The pulsed-power drilling system of claim 9, further comprising:

a controller; and a mechanical, hydraulic, pneumatic, or electrical actuator coupled to the fin and to the controller and configured to:

receive a control signal from the controller initiating actuation of the fin; and in response to receiving the control signal, move the fin in a direction such that the distal portion of the fin is extended away from the bit body proximate to the distal portion of the ground ring.

14. A method, comprising:

placing a pulsed-power drill bit downhole in a wellbore, the pulsed-power drill bit including:

a bit body;

an electrode coupled to the bit body and having a distal portion;

a ground ring coupled to the bit body proximate to the electrode, the ground ring having a distal portion for engaging with a sidewall surface of the wellbore and defining an outer diameter of the ground ring and a plurality of openings through which drilling fluid flows to remove fractured rock from the wellbore during pulsed drilling operations, the electrode and the ground ring positioned in relation to each other such that an electric field produced by a voltage applied between the ground ring and the electrode is enhanced at a portion of the electrode proximate to the distal portion of the electrode and at a portion of the ground ring proximate to the distal portion of the ground ring; and an actuatable, electrically conductive fin coupled to the distal portion of the ground ring such that the fin and the distal portion of the ground ring are electrically continuous, the fin being positioned such that when actuated, a distal portion of the fin is extended in a direction away from the bit body proximate to the distal portion of the ground ring, the fin further positioned in a track, channel, or slot between two of the plurality of openings through which the fin travels when actuated;

causing the fin to be actuated, creating an effective outer diameter of the ground ring that is greater than the outer diameter of the ground ring; and conducting pulsed-power drilling using the pulsed-power drill bit.

15. The method of claim 14, wherein the fin is one of a plurality of actuatable, electrically conductive fins, each of the plurality of fins being coupled to the distal portion of the ground ring such that the fin and the distal portion of the ground ring are electrically continuous.

16. The method of claim 14, wherein causing the fin to be actuated comprises:

receiving a first control signal initiating actuation of the fin; and moving, by a mechanical, hydraulic, pneumatic, or electrical actuator and in response to receiving the control signal, the fin in a direction such that the distal portion of the fin is extended away from the bit body proximate to the distal portion of the ground ring.

17. The method of claim 16, further comprising:

receiving a second control signal initiating actuation of the fin; and moving, in response to receiving the second control signal, the fin in a direction such that the distal portion of the fin is retracted toward the bit body proximate to the distal portion of the ground ring.

18. The method of claim 14, further comprising:

providing drilling fluid to the drill bit; and removing fractured rock from the end of the wellbore with the drilling fluid.

* * * * *